US010022852B2

(12) United States Patent
Ikuta et al.

(10) Patent No.: US 10,022,852 B2
(45) Date of Patent: Jul. 17, 2018

(54) IMPACT TOOL

(71) Applicant: MAKITA CORPORATION, Anjo-shi, Aichi (JP)

(72) Inventors: Hiroki Ikuta, Anjo (JP); Yoshitaka Machida, Anjo (JP); Masanori Furusawa, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 372 days.

(21) Appl. No.: 14/714,719

(22) Filed: May 18, 2015

(65) Prior Publication Data

US 2015/0328759 A1 Nov. 19, 2015

(30) Foreign Application Priority Data

May 16, 2014 (JP) ..... 2014-102791

(51) Int. Cl.

| | |
|---|---|
| ***B25D 17/24*** | (2006.01) |
| ***B25D 11/04*** | (2006.01) |
| ***B25D 11/12*** | (2006.01) |
| ***B25D 17/04*** | (2006.01) |

(52) U.S. Cl.

CPC ..... *B25D 17/24* (2013.01); *B25D 11/04* (2013.01); *B25D 11/12* (2013.01); *B25D 17/043* (2013.01); *B25D 2211/003* (2013.01); *B25D 2211/068* (2013.01); *B25D 2217/0088* (2013.01); *B25D 2217/0092* (2013.01); *B25D 2250/121* (2013.01); *B25D 2250/175* (2013.01);

(Continued)

(58) Field of Classification Search

CPC ..... B25D 17/24; B25D 11/04; B25D 17/12; B25D 17/043

USPC ..... 173/90, 91, 184, 201, 211, 162.2

See application file for complete search history.

(56) References Cited

U.S. PATENT DOCUMENTS 5,025,870 A 6/1991 Gantner
5,749,421 A * 5/1998 Johansson ..... B25D 9/16 173/128

(Continued)

FOREIGN PATENT DOCUMENTS

DE 493098 C 3/1930
DE 10 2008 000 937 A1 10/2009

(Continued)

OTHER PUBLICATIONS

Sep. 29, 2015 Extended Search Report issued in European Patent Application No. 15167881.0.

(Continued)

*Primary Examiner* — Nathaniel Chukwurah
(74) *Attorney, Agent, or Firm* — Oliff PLC

(57) ABSTRACT

An electrical hammer (100) comprises a main housing (101), a hand grip (500) connected to the main housing (101) via a compression coil spring (321). In the electrical hammer (100), a hammer bit (119) is driven by a first motion converting mechanism (120) and thereby a hammering operation is performed. During the hammering operation, the hand grip (500) is moved against the main housing (101) in a state that biasing force of the compression coil spring (321) is applied on the hand grip (500). Further, the electrical hammer (100) comprises a second motion converting mechanism (220) which drives a counterweight (231).

18 Claims, 16 Drawing Sheets

(52) U.S. Cl.
CPC .. *B25D 2250/245* (2013.01); *B25D 2250/275* (2013.01); *B25D 2250/371* (2013.01)

(56) References Cited

U.S. PATENT DOCUMENTS

| | | | | |
|---|---|---|---|---|
| 2002/0185288 | A1* | 12/2002 | Hanke | B25D 17/046 173/132 |
| 2004/0222001 | A1* | 11/2004 | Ikuta | B25D 11/125 173/210 |
| 2007/0017684 | A1* | 1/2007 | Stirm | B25D 11/062 173/109 |
| 2008/0029282 | A1* | 2/2008 | Ikuta | B25D 17/24 173/114 |
| 2008/0047723 | A1 | 2/2008 | Kamegai et al. | |
| 2008/0190632 | A1 | 8/2008 | Berger et al. | |
| 2009/0223691 | A1* | 9/2009 | Ikuta | B25D 17/24 173/117 |
| 2010/0051304 | A1 | 3/2010 | Aoki | |
| 2011/0226500 | A1* | 9/2011 | Furusawa | B25D 17/24 173/110 |
| 2012/0067605 | A1 | 3/2012 | Furusawa et al. | |

FOREIGN PATENT DOCUMENTS

| | | | |
|---|---|---|---|
| EP | 2384859 | A2 | 11/2011 |
| GB | 2 053 768 | A | 2/1981 |
| JP | 2005-254423 | A | 9/2005 |
| JP | 2007-513784 | A | 5/2007 |
| JP | 2008-073836 | A | 4/2008 |
| JP | 2009-056524 | A | 3/2009 |
| JP | 2010-052115 | A | 3/2010 |
| JP | 2010-247239 | A | 11/2010 |
| WO | 2009/121431 | A1 | 10/2009 |

OTHER PUBLICATIONS

Sep. 22, 2017 Office Action issued in Japanese Patent Application No. 2014-102791.

Mar. 2, 2018 Office Action issued in Japanese Patent Application No. 2014-102791.

* cited by examiner

IMPACT TOOL

CROSS REFERENCE TO RELATED APPLICATION

The present application claims priority from Japanese Patent Applications No. 2014-102791 filed on May 16, 2014, the entire contents of which are incorporated by reference herein.

FIELD OF THE INVENTION

The present invention relates to an impact tool which performs a predetermined operation.

BACKGROUND OF THE INVENTION

Japanese non-examined laid-open Patent Publication No. 2010-052115 discloses an impact tool which drives a tool bit linearly in its longitudinal direction by a swing member. The impact tool has a dynamic vibration reducer for reducing vibration generated during an operation.

SUMMARY OF THE INVENTION

In the impact tool described above, since a user holds a handle and operates the impact tool during the operation, vibration generated during the operation is transmitted to the user. In this respect, less vibration transmission to the user is preferable for ensuring usability. Thus, regarding vibration reducing technique of the impact tool, further improvement is desired.

Accordingly, an object of the present disclosure is, in consideration of the above described problem, to provide an improved vibration reduction technique for an impact tool.

Above-mentioned problem is solved by the present invention. According to a preferable aspect of the present disclosure, an impact tool which drives an elongate tool bit in a longitudinal direction of the tool bit and performs a predetermined operation is provided. The impact tool comprises a motor which includes a motor shaft, a driving mechanism which is driven by the motor and drives the tool bit, and a main housing which houses the driving mechanism. The main housing may house not only the driving but also the motor. The impact tool comprises a first crank mechanism which has a first rotation shaft and a first eccentric shaft which is offset from the rotational center of the first rotation shaft. The first crank mechanism is configured to be driven by the motor and drive the driving mechanism. That is, the first crank mechanism for driving the tool bit via the driving mechanism is provided.

Further, the impact tool comprises a handle which includes a grip portion extending in a cross direction crossing the longitudinal direction of the tool bit, and a biasing member which is arranged between the main housing and the handle and applies biasing force on the handle. The handle is configured to be moved with respect to the main housing. Thus, the handle is configured to prevent vibration transmission from the main housing to the handle during the operation by relatively moving with respect to the main housing in a state that the biasing force of the biasing member is applied on the handle. That is, the handle is formed as a vibration proof handle which prevents vibration transmission from the main housing by utilizing elastic deformation of the biasing member.

Further, the impact tool comprises a weight which is housed in the main housing and movable with respect to the main housing, and a second crank mechanism which has a second rotation shaft and a second eccentric shaft which is offset from the rotational center of the second rotation shaft. The second crank member is configured to be driven by the motor and drive the weight such that the weight is relatively moved with respect to the main housing. That is, the second crank mechanism for driving the weight is provided. The second crank mechanism may be connected to the motor shaft and driven by the motor or connected to the first crank mechanism and driven by the motor via the first crank mechanism.

According to this aspect, the weight reduces vibration generated on the main housing during the operation and the handle prevents the vibration from being transmitted to the handle from the main housing by relatively moving against the main housing in a state that the biasing member biases the handle. In other words, the impact tool has two kinds of vibration reduction mechanisms. Accordingly, vibration on the grip portion held by a user is reduced during the operation. As a result, usability of the impact tool is improved.

According to a further preferable aspect of the present disclosure, the impact tool comprises an intervening member which is arranged between the weight and the second eccentric shaft. The weight is driven by the second crank mechanism via the intervening member. In a construction in which the intervening member is provided by an elastic member, the weight and the elastic member serve as a dynamic vibration reducer. The weight of the dynamic vibration reducer is forcibly driven by the second crank mechanism.

According to a further preferable aspect of the present disclosure, a moving amount of the second eccentric shaft in the longitudinal direction of the tool bit is defined to be equal to a moving amount of the weight in the longitudinal direction of the tool bit. Accordingly, the second crank mechanism drives the weight in a predetermined phase. The weight may be connected directly to the second eccentric shaft without the intervening member.

According to a further preferable aspect of the present disclosure, the first and second eccentric shafts are disposed such that when the first eccentric shaft is positioned at the closest position to the tool bit in the longitudinal direction of the tool bit within its movable range, the second eccentric shaft is positioned at a position other than the closest position to the tool bit in the longitudinal direction of the tool bit and the most distant position from tool bit in the longitudinal direction of the tool bit within its movable range in the longitudinal direction of the tool bit. That is, the first and second eccentric shafts are driven other than the same phase and the opposite phase to each other. Accordingly, the weight driven by the second eccentric shaft is driven in a phase different from a phase of the hammering operation caused by the first eccentric shaft. Thus, the phase of the weight with respect to the phase of the hammering operation is effectively defined to reduce the vibration generated on the main housing during the operation.

According to a further preferable aspect of the present disclosure, the motor is arranged such that the motor shaft crosses the axial line of the tool bit.

According to a further preferable aspect of the present disclosure, the driving mechanism comprises a hammering element for hammering the tool bit, and a cylinder which holds the hammering element slidably therein. The cylinder is coaxial with the axial line of the tool bit. The weight is disposed corresponding to the cylinder.

Specifically, according to one aspect of the arrangement of the weight, the weight is arranged outside of the cylinder so as to surround at least part of the cylinder. That is, the weight is arranged outside of the cylinder on a cross section perpendicular to the axial direction of the cylinder. The weight is formed as substantially C-shaped or circular member to surround the cylinder on the cross section. The weight is arranged along the outer periphery of the cylinder in the axial direction of the cylinder. Accordingly, the weight is slid in the axial direction of the cylinder at the outer region of the cylinder.

Further, according to other aspect of the arrangement of the weight, the weight comprises a pair of weight components which are arranged at both outsides of the cylinder with respect to a plane including the axial line of the tool bit and a grip portion extending line, respectively. In other words, as the grip portion extends in a vertical direction of the impact tool, the weight components are arranged right and left sides of the cylinder, respectively. Accordingly, the pair of the weight components balances the impact tool in the lateral direction of the impact tool.

Further, according to another aspect of the arrangement of the weight, the weight is arranged in at least one of outer regions of the cylinder in the crossing direction. That is, as the grip portion extends in a vertical direction of the impact tool, the weight is arranged only in an upper region of the cylinder, only in a lower region of the cylinder or both in the upper and lower regions of the cylinder in the vertical direction. Typically, the weight is arranged on a plane including the axial line of the tool bit and a grip portion extending line. Accordingly, the weight is arranged on the singular plane with the grip portion and thereby usability of the impact tool is improved.

According to a further preferable aspect of the present disclosure, the gravity center of the weight is arranged so as to overlap with the cylinder on a cross section perpendicular to the axial line of the tool bit. That is, the gravity center point of the weight is located within the cylinder bore on the cross section perpendicular to the axial line of the tool bit. Typically, the weight is formed as substantially circular member in the cross section perpendicular to the axial line of the tool bit. Further, the weight may be provided by a plurality of weight components and the gravity center of the weight components may be located within the cylinder bore.

According to a further preferable aspect of the present disclosure, the handle is relatively moved with respect to the main housing in the longitudinal direction of the tool bit. In the impact tool, the tool bit is linearly driven in the longitudinal direction of the tool bit. Thus, vibration mainly in the longitudinal direction of the tool bit is generated on the main housing. Accordingly, as the handle is moved against the main housing in the longitudinal direction of the tool bit which is main component of the vibration, a vibration transmission from the main housing to the handle is effectively prevented.

Typically, the handle is moved with respect to the main housing on a plane including the axial direction of the tool bit and a grip portion extending line. In this aspect, whole of the handle may be moved with respect to the main housing parallel to the longitudinal direction of the tool bit or one end of the grip portion may be rotatably connected to the main housing and rotated with respect to the main housing. In such a construction in which the whole part of the handle is moved parallel to the longitudinal direction of the tool bit, the grip portion may be formed as a cantilever only one end of which is connected to the main housing, or both end of the grip portion may be connected to the main housing. On the other hand, in such a construction in which the grip portion is rotated with respect to the main housing, one end of the grip portion is connected to the main housing as a pivot, and another end of the grip portion is connected to the main housing via the biasing member arranged therebetween.

According to a further preferable aspect of the present disclosure, the impact tool comprises an outer housing which covers at least a part of a region of the main housing which houses the driving mechanism and the motor. The handle is connected to the outer housing and integrally moved with the outer housing with respect to the main housing. The biasing member is interveningly arranged between the outer housing and the main housing, and thereby the outer housing serves as a vibration proof housing. Accordingly, vibration transmission from the main housing to the outer housing during the operation is prevented. As a result, vibration transmission to the handle is prevented.

According to a further preferable aspect of the present disclosure, the impact tool comprises an auxiliary handle attachable part to which an auxiliary handle is detachably attached. The auxiliary handle attachable part is connected to the outer housing and integrally moved with the handle connected to the outer housing with respect to the main housing. Accordingly, the outer housing serves as not only the vibration proof housing but also a connecting part which connects the handle and the auxiliary handle attachable part. Thus, the auxiliary handle attached to the auxiliary handle attachable part and the handle are integrally moved against the main housing. As a result, usability of the impact tool for a user who holds the auxiliary handle and the handle is improved.

According to a further preferable aspect of the present disclosure, the first rotation shaft and the second rotation shaft are arranged coaxially with each other. In both constructions of the second crank mechanism is connected to the motor shaft and the second crank mechanism is connected to the first crank mechanism, as the first and second rotation shafts are coaxially arranged, rotation of the motor is rationally transmitted to the first and second crank mechanism.

According to a further preferable aspect of the present disclosure, the impact tool comprises a controller which controls rotation speed of the motor to be driven at substantially constant rotation speed. The substantially constant rotation speed means rotation speed within a predetermined range. That is, the controller controls the motor at a predetermined rotation speed within a predetermined range even though rotation speed of the motor may be fluctuated due to load applied on the motor during the operation. In other words, the motor is controlled at substantially constant rotation speed state by the controller. Accordingly, the motor keeps the predetermined rotation speed in spite of load applied on the motor during the operation. As a result, working efficiency of the impact tool is prevented from fluctuating. Specifically, in a case that the motor serves as a brushless motor, a controller for driving the brushless motor is necessary. Thus, by utilizing the controller for driving the brushless motor, the motor is driven in substantially constant rotation speed.

Accordingly, an improved vibration reduction technique for an impact tool is provided.

Other objects, features and advantages of the present disclosure will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved impact tools and method for using such impact tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
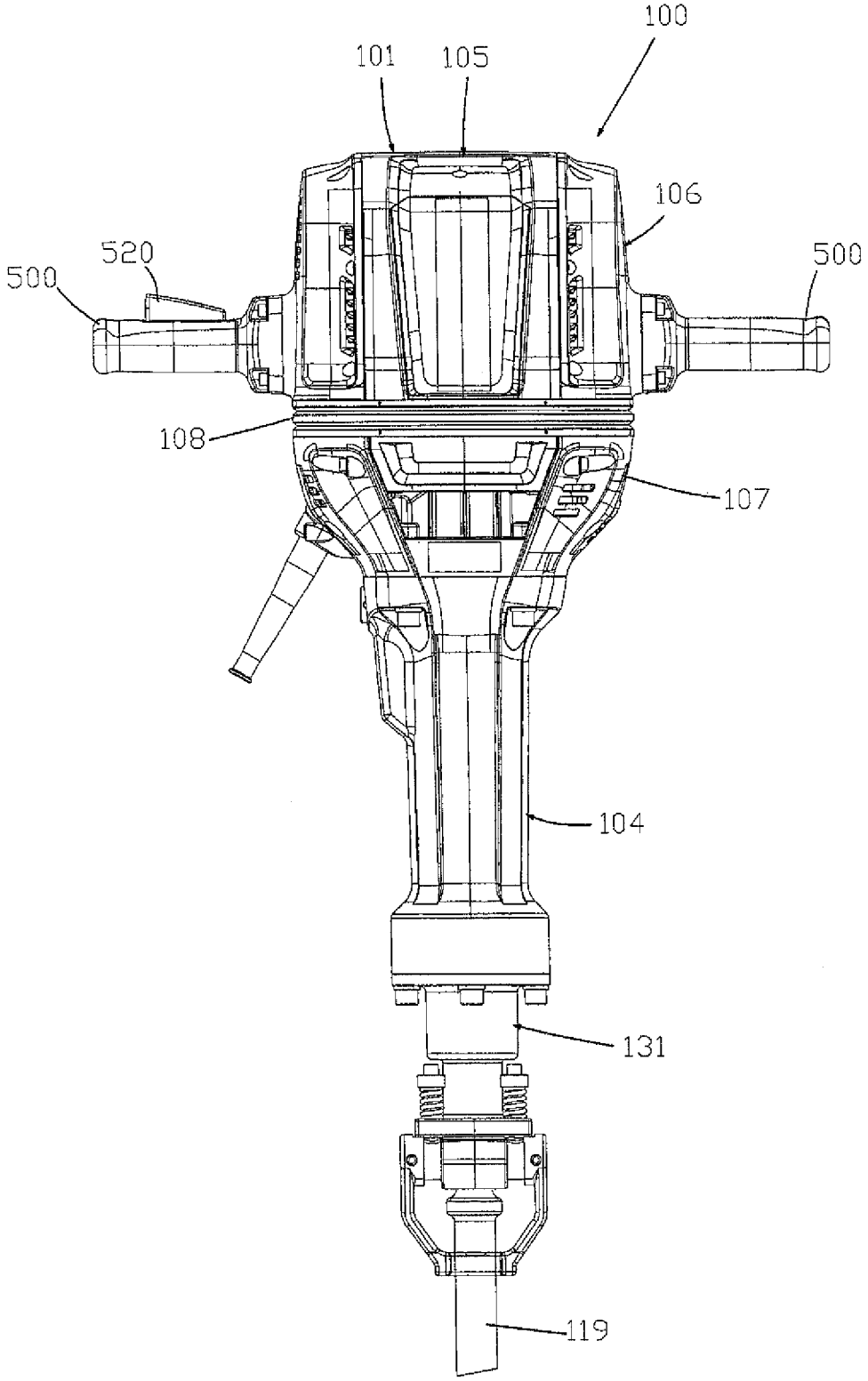
FIG. 1 shows a front view of an electrical hammer according to a first embodiment of the present disclosure.
Figure 2:
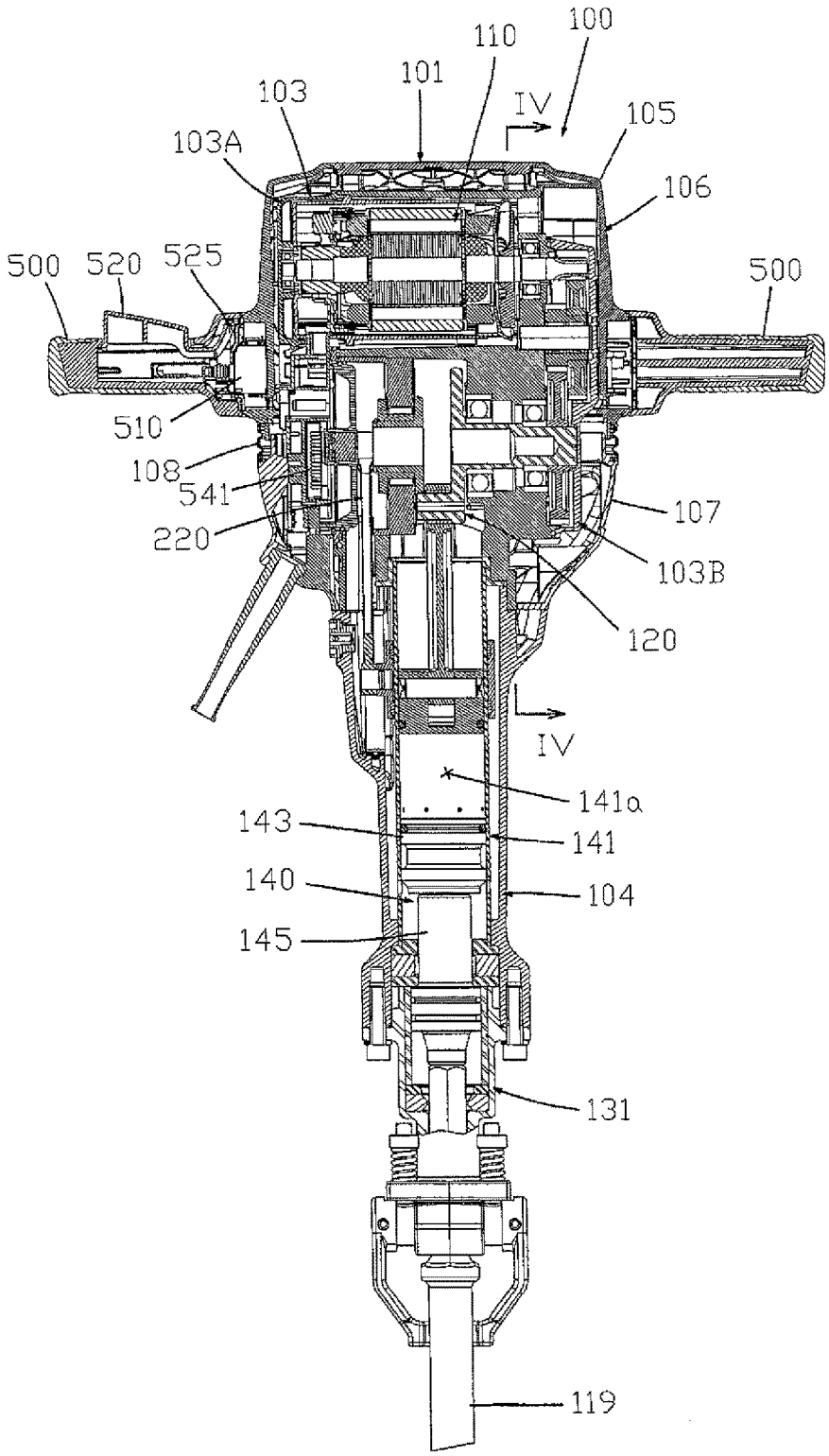
FIG. 2 shows a cross sectional view of the electrical hammer.

A first embodiment of the present disclosure is explained with reference to FIG. 1 to FIG. 5. In the first embodiment, an electrical hammer is utilized to explain as one example of an impact tool. As shown in FIG. 1 and FIG. 2, the electrical hammer 100 is an impact tool which linearly drives a hammer bit 119 in a longitudinal direction of the hammer bit 119, which is attached to a front region of a main body 101 of the electrical hammer 100 and thereby the hammer bit 119 performs a chipping operation on a workpiece (for example concrete). The chipping operation is also called as a hammering operation. The hammer bit 119 is detachably attached to the main body via a cylindrical tool holder 131. The hammer bit 119 is inserted into a bit inserted hole of the tool holder 131 and held by the tool holder 131 such that relative rotation of the hammer bit 119 with respect to the tool holder 131 is prevented. Thus, an axial line of the tool holder 131 is in conformity with the longitudinal direction of the hammer bit 119. The hammer bit 119 is one example which corresponds to "a tool bit" of this disclosure.

As shown in FIG. 2, the main body 101 is mainly provided with a main housing 103, a barrel portion 104, and an outer housing 105. The main housing 103 comprises a motor housing 103A which houses an electric motor 110, and a gear housing 103B which houses a first motion converting mechanism 120 and the second converting mechanism 220. The barrel portion 104 is a cylindrical member which housed a part of a hammering mechanism and the tool holder 131. The motor housing 103A, the gear housing 103B, and the barrel portion 104 are made of aluminum. The barrel portion 104, the gear housing 103B and the motor housing 103A are disposed in this order in the longitudinal direction of the hammer bit 119 and fixedly connected to each other. The barrel portion 104 is disposed close to the hammer bit 119 and the motor housing 103A is disposed remote from the hammer bit 119. The motor housing 103A and the gear housing 103B may be formed integrally by molding aluminum. The main housing 103 is one example which corresponds to "a main housing" of this disclosure.

An outer housing 105 is disposed outside the main housing 103. The outer housing 105 is cylindrically formed so as to extend in the longitudinal direction of the hammer bit 119 and cover the whole main housing 103. A pair of hand grips 500 held by a user during the chipping operation to operate the electrical hammer 100 is disposed on the outer housing 105. The pair of the hand grips 500 is symmetrically disposed with respect to an axial line extending in the longitudinal direction of the hammer bit 119. Further, each hand grip 500 linearly extends in a direction perpendicular to the axial line of the hammer bit 119. One end of the hand grip 500 is connected and fixed to the outer housing 105. Therefore, the hand grip 500 is formed as a cantilever. The hand grip 500 is one example which corresponds to "a handle" of this disclosure. Further, the outer housing 105 is one example which corresponds to "an outer housing" of this disclosure.

The electrical hammer 100 is constructed as a large-size hammer of approximately 30 kilogram. Accordingly, a user holds the pair of the hand grips 500 by respective hands and, basically, operates the electrical hammer 100 such that the hammer bit 119 is disposed downwardly during the chipping operation. Therefore, for convenience of explanation, the hammer bit 119 side in the longitudinal direction of the hammer bit 119 (longitudinal direction of the main body 101) is called lower side of the electrical hammer 100, and the hand grip 500 side in the longitudinal direction of the hammer bit 119 is called upper side of the electrical hammer 100.

Figure 3:
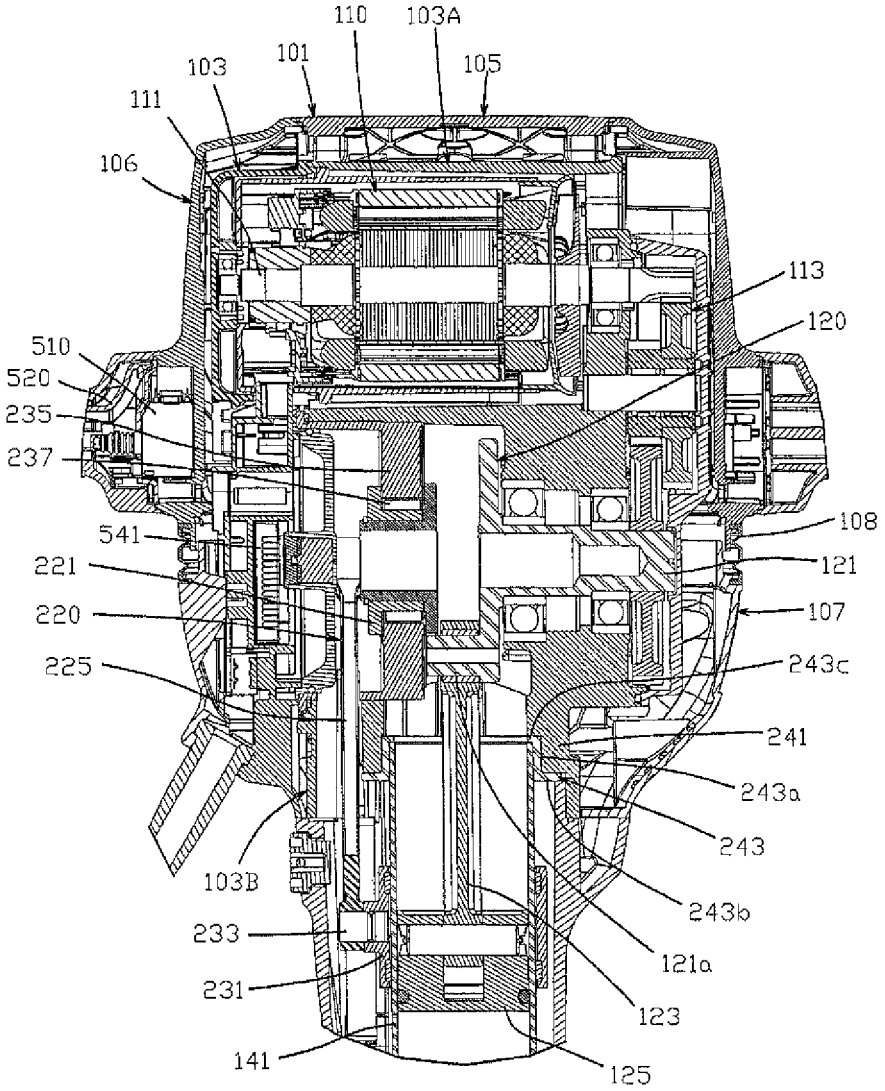
FIG. 3 shows a partially enlarged cross sectional view of FIG. 2.

As shown in FIG. 2 and FIG. 3, the outer housing 105 is formed by connecting a plurality of housing elements. The outer housing 105 is substantially elongate rectangular cylinder along the longitudinal direction of the hammer bit 119 and its lower end is opened. Specifically, as shown in FIG. 1 and FIG. 2, the outer housing 105 is mainly provided with an upper housing 106, a lower housing 107 and an expandable bellows member 108 which connects the upper housing 106 and the lower housing 107 in the longitudinal direction of the hammer bit 119.

Figure 4:
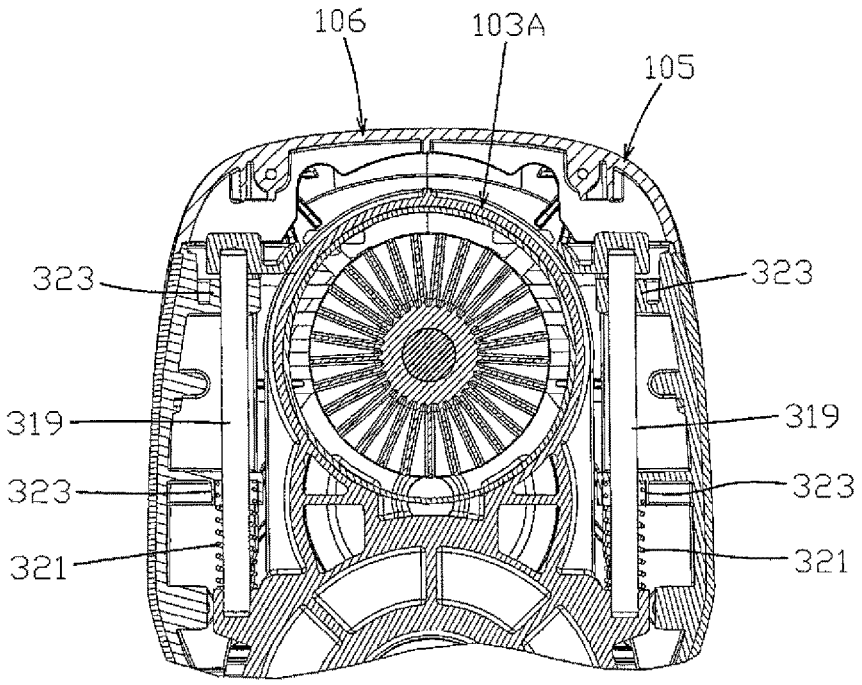
FIG. 4 shows a cross sectional view taken along the IV-IV line in FIG. 2.

As shown in FIG. 4, the upper housing 106 of the outer housing 105 having the hand grip 500 is provided as a vibration proof handle which is connected to the main housing 103 via a plurality of guide shafts 319 and compression coil springs 321 as an elastic member in a relatively movable manner against the main housing 103 in the longitudinal direction of the hammer bit 119. Specifically, the guide shaft 319 having a circular section is disposed on the main housing 103 for guiding the upper housing 106 in the longitudinal direction of the hammer bit 119. Four guide shafts 319 are disposed outside the main housing 103 at front, rear, right and left sides of the main housing 103. A slide cylinder 323 is disposed on an inner surface of the upper housing 105 and fitted to the guide shaft 319 in a slidable manner. Further, the compression coil spring 321 is disposed coaxially with the guide shaft 319. The compression coil spring 321 is disposed so as to elastically contact with the outer housing 106 and the main housing 103, respectively. Thus, the outer housing 106 and the main housing 103 are elastically connected. The lower housing 107 of the outer housing 105 is fixed to the main housing 103. Accordingly, the bellows member 108 allows the upper housing 106 and the lower housing 107 to relatively move to each other by expanding/contracting. The compression coil spring 321 is one example which corresponds to "a biasing member" of this disclosure.

As shown in FIG. 2, the hand grip 500 is an elongated hollow cylindrical member made of resin and extends in a direction crossing the longitudinal direction of the hammer bit 119. An electrical switch 510 to switch a turn-on and turn-off of the electric motor 110 is disposed inside one of the hand grips 500 and a trigger 520 for operating the electrical switch 510 is disposed on the same hand grip 500. The trigger 520 is disposed such that it is rotatable around a support part 525 disposed in the hand grip 500 as a fulcrum in a direction crossing the longitudinal direction of the hand grip 500. The trigger 520 is biased by a biasing spring embedded inside the electrical switch 510 and thereby the trigger 520 is normally, as a non-operated state, protruded outwardly (upwardly) from an upper surface of the hand grip 500. Thus, when the trigger 520 is operated by a user and rotated around the supporting part 525 into the hand grip 500, the electrical switch 510 is operated. By the operation of the electrical switch 510, the electric motor 110 is turned on and driven.

As shown in FIG. 3, a controller 541 for controlling the driving of the electric motor 110 is disposed between an outer surface of the main housing 103 and an inner surface of the outer housing 105. The controller 541 is disposed at a predetermined region close to the electrical switch 510 and below the electric motor 110. The controller 541 drives the electric motor 110 so as to control a rotation speed of the electric motor 110 within a predetermined speed range. That is, the controller 541 controls the rotation speed of the electric motor 110 in order to prevent drastic fluctuation of the rotation speed based on a load during the operation. In other words, the controller 541 controls the electric motor 110 under substantially constant rotation speed state.

The electric motor 110 is driven by current provided from AC power source. As shown in FIG. 2, the electric motor 110 is disposed such that a motor shaft 111 crosses the axial line of the hammer bit 119 and the motor shaft 111 is parallel to the longitudinal axis of the hand grip 500. The electric motor 110 and the motor shaft 111 are examples which correspond to "a motor" and "a motor shaft" of this disclosure, respectively.

As shown in FIG. 3, rotation of the electric motor 110 is converted to a linear motion by the first motion converting mechanism 120 and transmitted to the hammering mechanism 140 and thereby the hammer bit 119 is hit by the hammering mechanism 140 downwardly in the longitudinal direction of the hammer bit 119. Thus, a hammering force by the hammer bit 119 against a workpiece is generated. Furthermore, the rotation of the electric motor 110 is converted to a linear motion by the second motion converting mechanism 220 and transmitted to a counterweight 231. The counterweight 231 is linear moved in the longitudinal direction of the hammer bit 119 corresponding to a timing of a reaction force from a workpiece based on the hammering force by the hammer bit 119. Accordingly, the counterweight 231 reduces vibration caused on the electrical hammer 100. The counterweight 231 is one example which corresponds to "a weight" of this disclosure.

As shown in FIG. 3, the first motion converting mechanism 120 is provided by a first crank mechanism disposed below the electric motor 110, which is mainly provided with a first crank shaft 121, a first connection rod 123 and a piston 125. The first motion converting mechanism 120 is driven by the electric motor 110 via a gear mechanism 113 comprising a plurality of gears. The piston 125 serves as a driving element which drives the hammering mechanism 140. The piston 125 is disposed within a cylinder 141 in a slidable manner in the longitudinal direction of the hammer bit 119. The first crank shaft 121 is disposed to be parallel to the motor shaft 111 of the electric motor 110. Further, an eccentric shaft 121*a* is formed integrally with the first crank shaft 121. The eccentric shaft 121*a* is rotatably connected to the first connection rod 123. The eccentric shaft 121*a* is disposed to be offset from a rotational axis of the first crank shaft 121 in a radial direction of the first crank shaft 121. The first motion converting mechanism 120 is one example which corresponds to "a first crank mechanism" of this disclosure.

As shown in FIG. 2, the hammering mechanism 140 is mainly provided with the cylinder 141, a striker 143 as a hammering element and an impact bolt 145 as an intermediate element. The striker 143 is slidably disposed in the cylinder 141. The impact bolt 145 is slidably disposed in the tool holder 131 and transmits kinetic energy of the striker 143 to the hammer bit 119. The cylinder 141 is disposed above the tool holder 131 coaxially with the tool holder 131. An air chamber 141*a* is formed in the cylinder 141 partitioned by the piston 125 and the striker 143. The striker 143 is driven by an air spring (air fluctuation) of the air chamber 141*a* caused by a sliding of the piston 125. When the striker 143 is driven, the striker 143 hits the impact bolt 145 and thereby the impact bolt 145 hits the hammer bit 119. The hammering mechanism 140 is one example which corresponds to "a driving mechanism" of this disclosure. Further, the cylinder 141 and the striker 143 are examples which correspond to "a cylinder" and "a hammering mechanism" of this disclosure, respectively.

Figure 5:
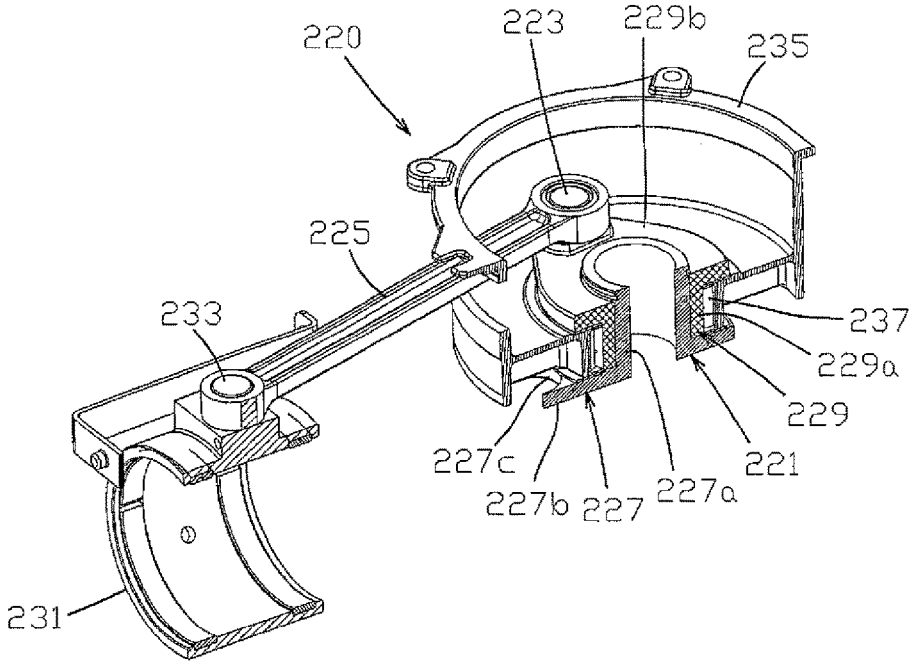
FIG. 5 shows a perspective cross sectional view of a counterweight and a second motion converting mechanism.

As shown in FIG. 3 and FIG. 5, the second motion converting mechanism 220 is provided by a second crank mechanism which is mainly provided with a second crank shaft 221, an eccentric shaft 223 and a second connection rod 225. The second crank shaft 221 is arranged coaxially with the first crank shaft 121 of the first crank mechanism and driven by the eccentric shaft 121*a* of the first crank shaft 121. The eccentric shaft 223 is disposed to be offset from a rotational axis of the second crank shaft 221. The eccentric shaft 223 is disposed to be parallel to the second crank shaft 221. One end of the second connection rod 225 is rotatably connected to the eccentric shaft 223. Another end of the second connection rod 225 is rotatably connected to a connection shaft 233 which is formed on the counterweight 231. The connection shaft 233 is arranged to be parallel to the eccentric shaft 223. The counterweight 231 is a cylindrical member loosely and slidably fitted onto the cylinder 141. That is, the counterweight 231 and the cylinder 141 are disposed coaxially with each other. The counterweight 231 is linearly reciprocated between a front position which is close to the hammer bit 119 and area position which is remote from the hammer bit 119 by the second crank mechanism. In this embodiment, the counterweight 231 is formed cylindrically, however the counterweight 231 may be formed approximately C-shaped member which surrounds a part of the cylinder 141. The second motion converting mechanism 220 is one example which corresponds to "a second crank mechanism" of this disclosure. Further, the second connection rod 225 is one example which corresponds to "an intervening member" of this disclosure.

As shown in FIG. 5, the second crank shaft 221 is provided with an inner crank shaft 227 and an outer crank shaft 229. The inner crank shaft 227 is provided with a cylindrical shaft portion 227*a* and a flange portion 227*b* which protrudes outwardly from one end of the shaft portion 227*a* in a radial direction of the shaft portion 227*a*. The outer crank shaft 229 is provided with a cylindrical shaft portion 229*a* and a flange portion 229*b* which protrudes outwardly from one end of the shaft portion 229*a* in a radial direction of the shaft portion 229*a*. The inner crank shaft 227 and the outer crank shaft 229 are fixedly assembled such that the flange portion 227*b* of the inner crank shaft 227 and the flange portion 229*b* of the outer crank shaft 229 are arranged opposite to each other in the axial direction of the second crank shaft 221. That is, the flange portion 227*b* is disposed at one end of the second crank shaft 221 and the flange portion 229*b* is disposed at another end of the second crank shaft 221. The inner crank shaft 227 and the outer crank shaft 229 are disposed such that the shaft portion 227*a* and the shaft portion 229*a* are to be coaxial to each other. That is, the shaft portion 229*a* is disposed outside the shaft portion 227*a*. Further, a connection hole 227*c* is formed on the flange portion 227*b*. The eccentric shaft 121*a* of the first crank shaft 121 of the first crank mechanism is inserted into the connection hole 227*c* and thereby the inner crank shaft 227 is rotatably connected to the eccentric shaft 121. Further, the eccentric shaft 223 is formed on the flange portion 229*b* of the outer crank shaft 229. The eccentric shaft 223 is rotatably connected to the second connection rod 225. That is, the second crank shaft 221 is formed by the inner crank shaft 227 as a driving side shaft and the outer crank shaft 229 as a driven side shaft.

The second crank shaft 221 is rotatably supported such that the shaft portion 229*a* of the outer crank shaft 229 is held by a needle bearing 237 which is held by a bearing holder 235. Accordingly, the second crank shaft 221 is held by the bearing holder 235. The bearing holder 235 is held by the gear housing 103B which is one component of the main housing 103.

As shown in FIG. 3, in a predetermined region of the gear housing 103B, which corresponding to an upper part of the cylinder 141, a cylindrical cylinder receiver 241 which surrounds the upper part of the cylinder 141 is formed. Thus, the cylinder 141 is held by the cylinder receiver 241 via a cylinder receiving member 243 made of metal.

In the electrical hammer 100 described above, a user holds the pair of the hand grips 500 by his/her each hand and makes the electrical hammer 100 to perform the operation in a state that the hammer bit 110 extends downwardly. The user pushes the trigger 520 by his/her one hand which holds one of the hand grips 500 and switches the electrical switch 510 into turn-on state, and thereby the electric motor 110 is driven. Thus, the hammer bit 119 is linearly driven by the first motion converting mechanism 120 and the hammering mechanism 140 and thereby the hammering operation on a workpiece is performed.

At this time, the counterweight 231 corresponding to the drive of the hammer bit 119 is linearly driven in the longitudinal direction of the hammer bit 119 by the second motion converting mechanism 220. The counterweight 231 is set to be driven in an approximately opposite phase against the striker 143. That is, when the striker 143 is moved downward, the counterweight 231 is moved upward. And when the striker 143 is moved upward, the counterweight 231 is moved downward. Accordingly, the counterweight 231 prevents vibration generated on the electrical hammer 100 during the hammering operation. Further, the counterweight 231 may be set to be driven in an approximately opposite phase against the impact bolt 145.

Specifically, phase differences between the phase of the eccentric shaft 223 of the second motion converting mechanism 220 and the phase of the eccentric shaft 121*a* of the first motion converting mechanism 120 is set to approximately 90 degrees. Further, as the striker 143 and the impact bolt 145 are driven by the air spring of the air chamber 141*a*, phase differences between the driving of the eccentric shaft 121*a* and the driving of the striker 143 and the impact bolt 145 is occurred. By taking the phase differences into consideration, the phase differences between the eccentric shaft 223 and the eccentric shaft 121*a* is preferably set to a predetermined phase other than the opposite phase.

During the hammering operation, the hand grip 500 (outer housing 105) is moved against the main housing 103 in the longitudinal direction of the hammer bit 119 in a state that biasing force of the compression coil spring 321 is applied to the hand grip 500. That is, kinetic energy of the vibration generated by the hammering operation makes the compression coil spring 321 expand/contract and thereby vibration transmission to the hand grip 500 from the main housing 103 is prevented. That is, the electric hammer 100 has two vibration preventing mechanism of the vibration proof handle (hand grip 500) and the counterweight 231, and thereby vibration transmission to a user's hand holding the hand grip 500 is prevented during the hammering operation. As a result, operability of the electrical hammer 100 is improved.

Second Embodiment

Next, a second embodiment of the present disclosure is explained with reference to FIG. 6 to FIG. 12. In the second embodiment, constructions of a handle and a counterweight (dynamic vibration reducer) of an electrical hammer 200 are different from those of the electrical hammer 100 of the first embodiment. Accordingly, similar constructions that are the same as those in the first embodiment have been assigned the same reference numbers.

Figure 8:
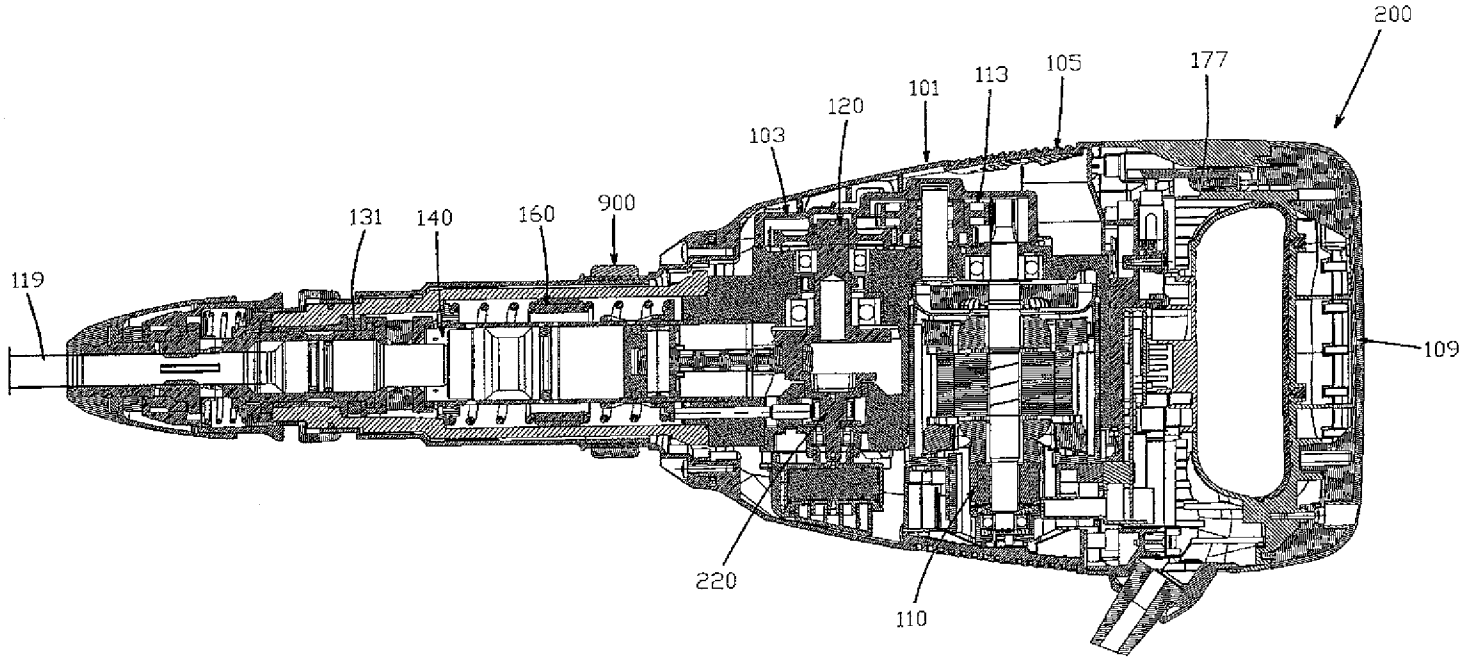
FIG. 8 shows a cross sectional view of the electrical hammer.

As shown in FIG. 8, the main body 101 is mainly provided with a main housing 103, an outer housing 105 which covers the main housing 103 and a hand grip 109 which is connected to the outer housing 105.

Figure 9:
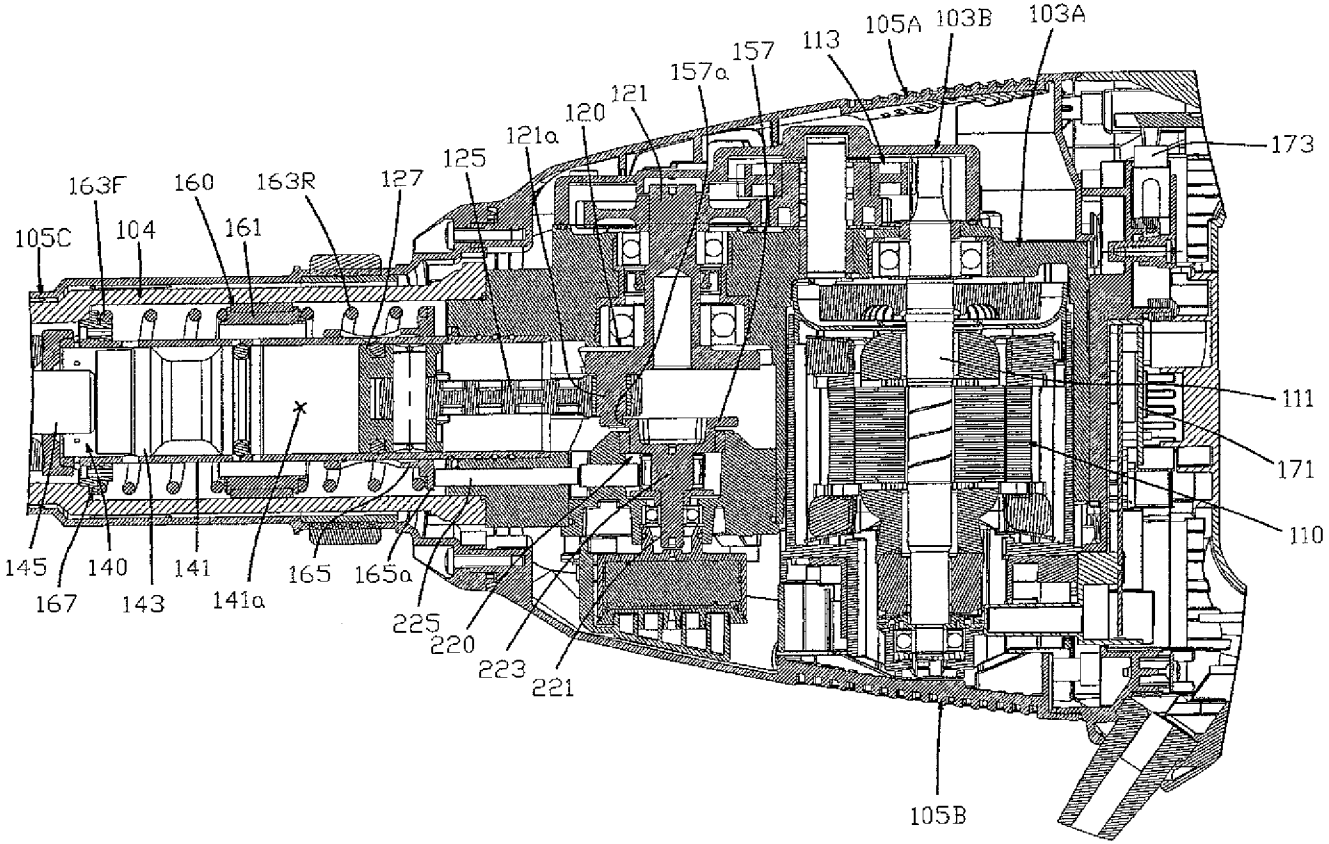
FIG. 9 shows a partially enlarged cross sectional view of FIG. 8.
Figure 10:
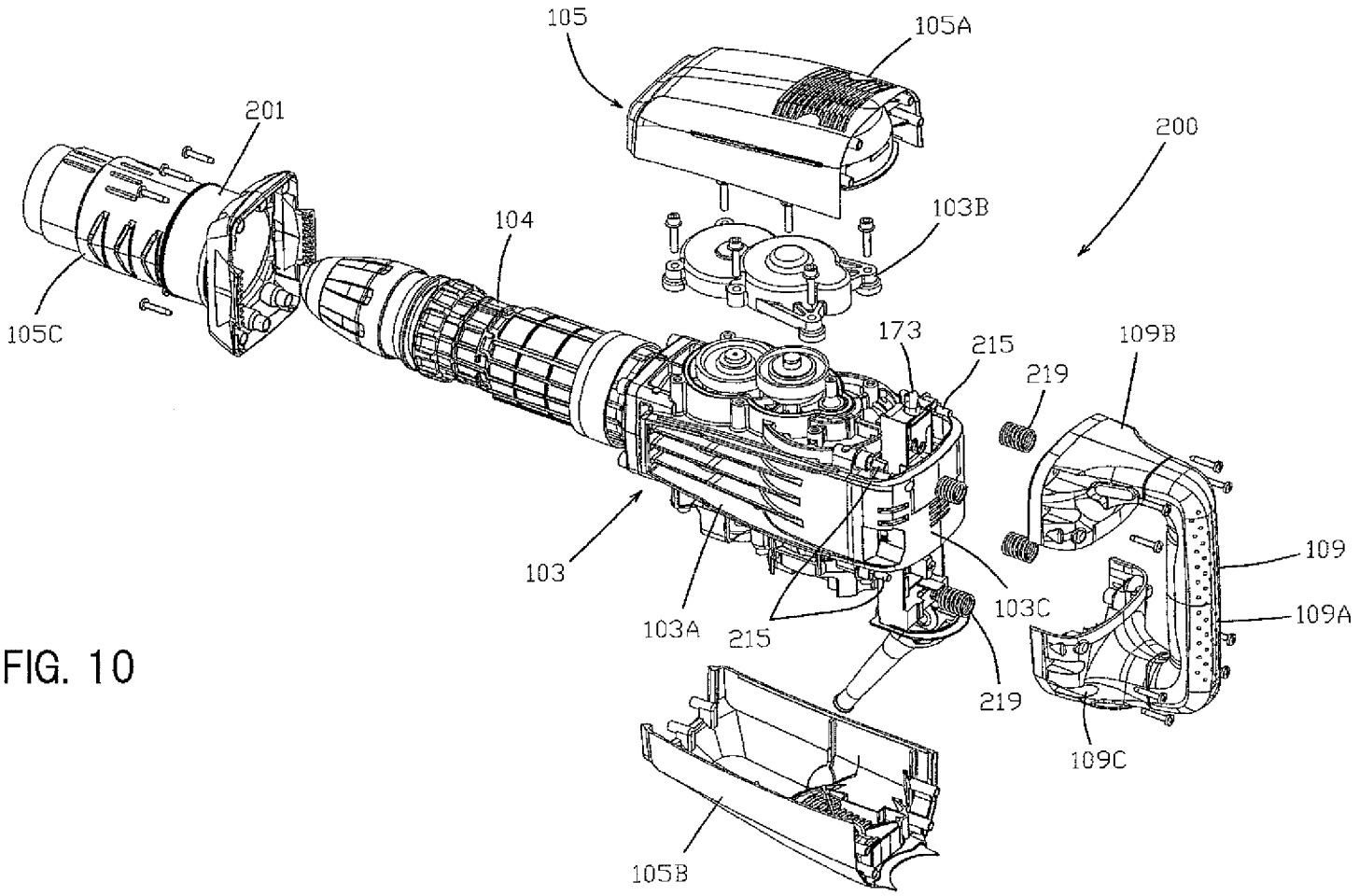
FIG. 10 shows an exploded perspective view of the electrical hammer.

As shown in FIG. 9 and FIG. 10, the main housing 103 is mainly provided with a motor housing 103A which houses a first motion converting mechanism 120 and a second converting mechanism 220, a gear housing 103B which houses a gear mechanism 113, a rear cover 103C which covers electrical elements, and a barrel cover 104 which houses a hammering mechanism 140. The main housing 103 is one example which corresponds to "a main housing" of this disclosure.

Figure 6:
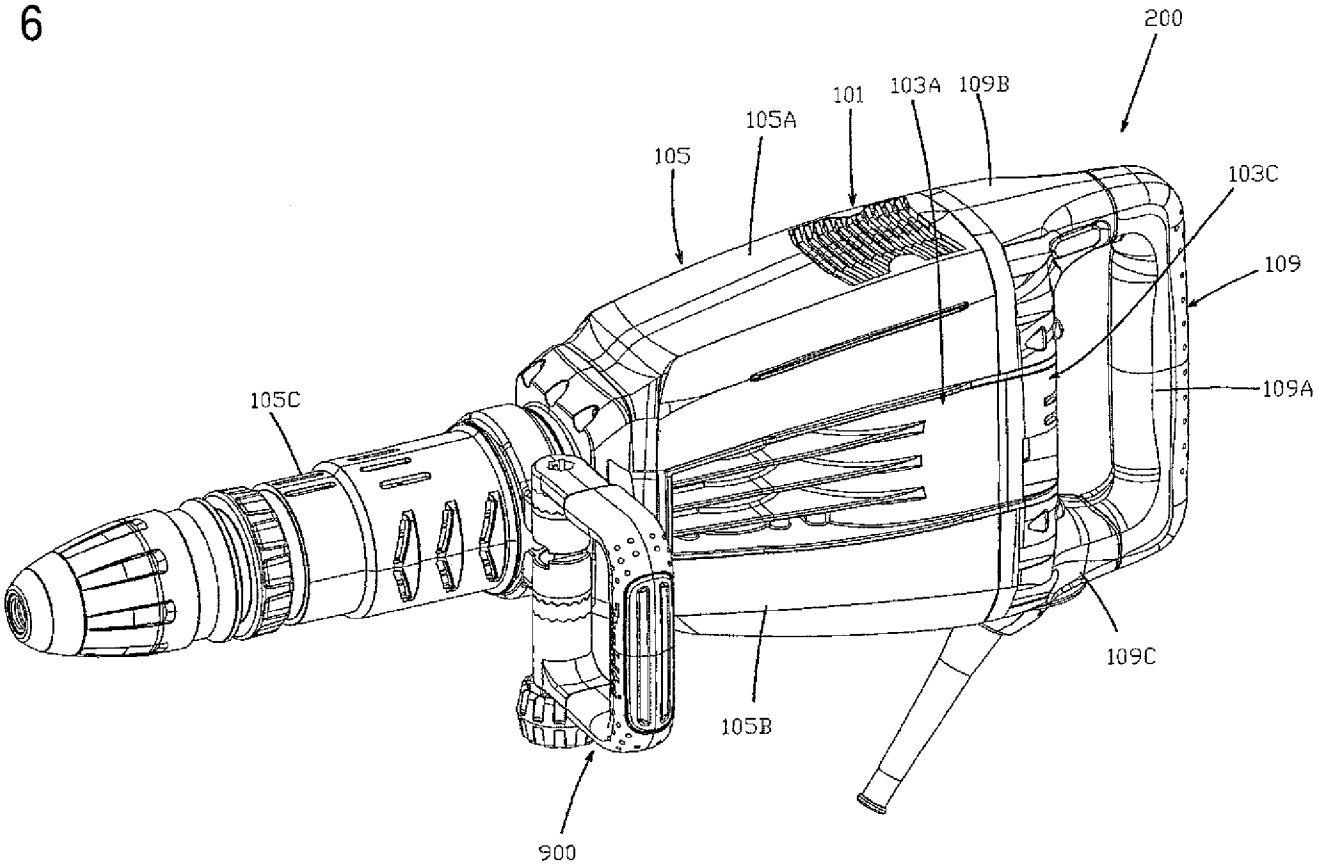
FIG. 6 shows a perspective view of an electrical hammer according to a second embodiment of the present disclosure.
Figure 7:
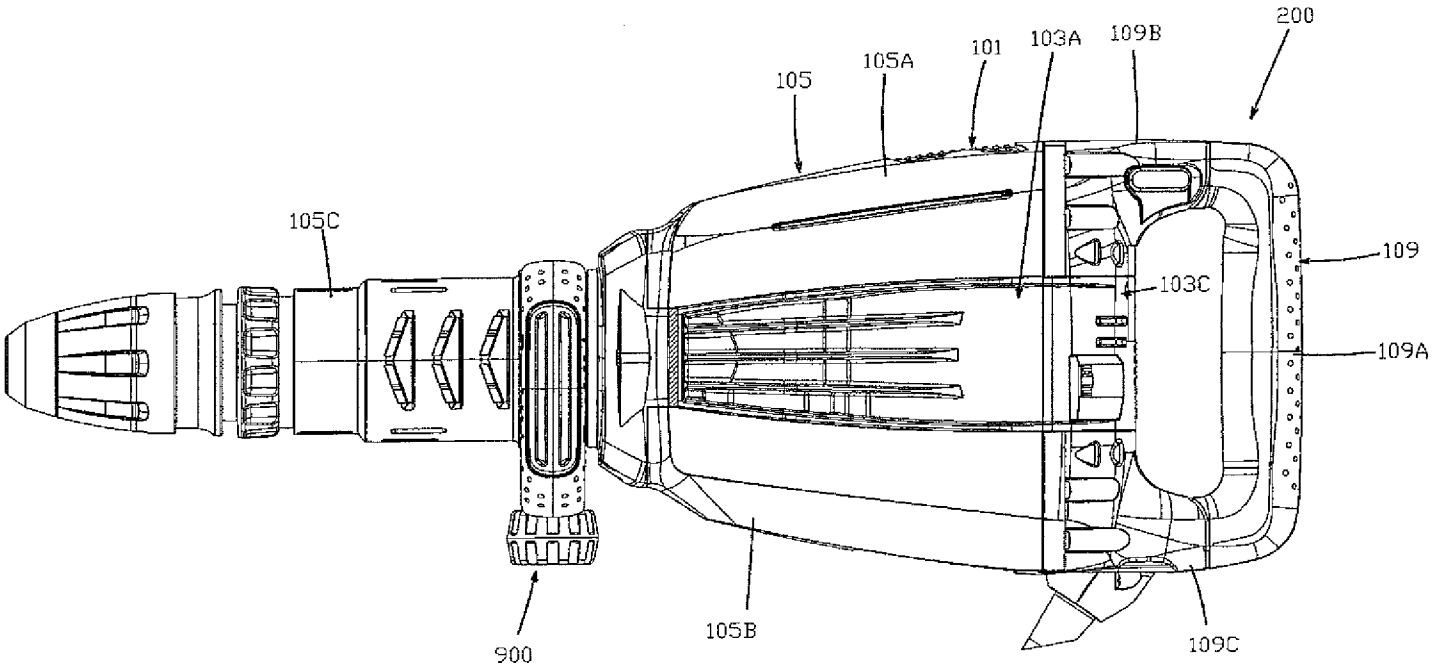
FIG. 7 shows a side view of the electrical hammer.

As shown in FIG. 6 to FIG. 8, the hand grip 109 held by a user is disposed on the outer housing 105 opposite to the hammer bit 119 in the longitudinal direction of the hammer bit 119. For convenience of explanation, the hammer bit 119 side in the longitudinal direction of the hammer bit 119 (longitudinal direction of the main body 101) is called front side of the electrical hammer 200, and the hand grip 109 side is called rear side of the electrical hammer 200. The hand grip 109 is one example which corresponds to "a handle" of this disclosure.

As shown in FIG. 8, an electric motor 110 is disposed such that a motor shaft 111 is parallel to a grip portion 109A of the hand grip 109. Further, the electric motor 110 is disposed such that the motor shaft 111 is perpendicular to the axial line of the hammer bit 119. Further, both of the electric motor 110 and the grip portion 109A are disposed on an extended line of the axial line of the hammer bit 119.

Rotation of the electric motor 110 is transmitted to the first motion converting mechanism 120 via the gear mechanism 113 and converted to a linear motion by the first motion converting mechanism 120. Thereafter, the linear motion is transmitted to the hammering mechanism 140 and thereby the hammer bit 119 is hit by the hammering mechanism 140 in the longitudinal direction of the hammer bit 119. Thus, a hammering force by the hammer bit 119 against a workpiece is generated. Furthermore, the rotation of the electric motor 110 is transmitted to the second motion converting mechanism 220 via the first motion converting mechanism 120 and converted to a linear motion by the second motion converting mechanism 220 and thereafter transmitted to a dynamic vibration reducer 160. The first motion converting mechanism 120, the gear mechanism 113 and the hammering mechanism 140 have similar constructions as those in the first embodiment, and explanations thereof are therefore omitted.

As shown in FIG. 9, the second motion converting mechanism 220 is mainly provided with a second crank shaft 221 which is rotationally driven by the eccentric shaft 121*a* of the first crank shaft 121 of the first motion converting mechanism 120, an eccentric shaft 223 which is formed integrally with the second crank shaft 221, and a second connection rod 225 which is linearly driven in the longitudinal direction of the hammer bit 119 by rotation of the eccentric shaft 223 around a rotational axis of the crank shaft 221. The second connection rod 225 drives the dynamic vibration reducer 160.

As shown in FIG. 9, the dynamic vibration reducer 160 is mainly provided with a weight 161, biasing springs 163F, 163R. The weight 161 is disposed in the barrel portion 104 and formed cylindrically to surround periphery of the cylinder 141. The biasing springs 163F, 163R are disposed in front and rear of the weight 161 in the longitudinal direction of the hammer bit 119, respectively. When the weight 161 is moved in the longitudinal direction of the hammer bit 119, the biasing springs 163F, 163R apply biasing force in the longitudinal direction of the hammer bit 119 on the weight 161.

The weight 161 is slidable in a state that the outer surface of the weight 161 contacts with the inner surface of the barrel portion 104. The biasing springs 163F, 163R are provided by compression coil springs, respectively. The rear side biasing spring 163R is disposed such that one end of the biasing spring 163R contacts with a front surface of a flange portion 165*a* of a slide sleeve 165 as a spring receiving member and another end of the biasing spring 163R contacts with a rear part of the weight 161. Further, the front side biasing spring 163F is disposed such that one end of the biasing spring 163F contacts with a front part of the weight 161 and another end of the biasing spring 163F contacts with a ring-like member 167 as a spring receiving member which is fixed on the barrel portion 104. The slide sleeve 165 is slidable in the longitudinal direction of the hammer bit 119 with respect to the cylinder 141 along the periphery of the cylinder 141. The slide sleeve 165 is contactable with the front end of the second connection rod 225. Thus, the slide sleeve 165 is slid by the second motion converting mechanism 220. The weight 161 is one example which corresponds to "a weight" of this disclosure. Further, the biasing spring 163R is one example which corresponds to "an intervening member" and "an elastic member" of this disclosure. Further, the slide sleeve 165 is one example which corresponds to "an intervening member" of this disclosure.

When the second connection rod 225 is moved forward, the slide sleeve 165 is pushed forward by the second connection rod 225 and the slide sleeve 165 compresses the biasing springs 163F, 163R against the biasing force of the biasing springs 163F, 163R. On the other hand, when the second connection rod 225 is moved rearward, the slide sleeve 165 is pushed rearward by the biasing force of the biasing spring 163F. That is, during the hammering operation, the weight 161 of the dynamic vibration reducer 160 is forcibly driven by the second motion converting mechanism 220 via the biasing springs 163F, 163R. Accordingly, vibration generated on the main housing 103 during the hammering operation is reduced. In this case, phase differences between the eccentric shaft 223 of the second motion converting mechanism 220 and the eccentric shaft 121*a* pf the first motion converting mechanism 120 is set similar to the one in the first embodiment.

As shown in FIG. 9 and FIG. 10, the outer housing 105 which is disposed outside the main housing 103 is mainly provided with an upper housing cover 105A, a lower housing cover 105B and a barrel cover 105C. All of the upper housing cover 105A, the lower housing cover 105B and the barrel cover 105C are made of resin.

The barrel cover 105 is a cylindrical member which covers a part of the barrel portion 104 of the main housing 103 other than the front end region of the barrel portion 104. The rear end of the barrel cover 105C is contacted and engaged with the front end of the upper housing cover 105A and the lower housing cover 105B, and fixedly connected by a plurality of screws.

As shown in FIG. 10, the hand grip 109 made of resin is disposed behind the outer housing 105. The hand grip 109 is mainly provided with the grip portion 109A which extends in a vertical direction crossing the longitudinal direction of the hammer bit 119, a upper connection part 109B which is formed on one end of the grip portion 109A in an extending direction of the grip portion 109A, and lower connection part 109C which is formed on another end of the grip portion 109A in the extending direction of the grip portion 109A. The upper connection part 109B and the lower connection part 109C are disposed to face to each other in a predetermined interval in the extending direction of the grip portion 109A. The upper connection part 109B extends to the upper housing cover 105A and the lower connection part 109C extends to the lower housing cover 105B. The hand grip 109 is mounted such that the upper connection part 109B is engaged and connected with the upper housing cover 105A and the lower connection part 109C is engaged and connected with the lower housing cover 105B. The outer housing 105 is one example which corresponds to "an outer housing" of this disclosure.

The outer housing 105 and the hand grip 109 are connected to the main housing 103 via a slide guide 211 and a compression coil spring 219 in a relatively slidable manner in the longitudinal direction of the hammer bit 119, and thereby a vibration proof handle is constructed. The compression coil spring 219 is one example which corresponds to "a biasing member" of this disclosure.

Figure 11:
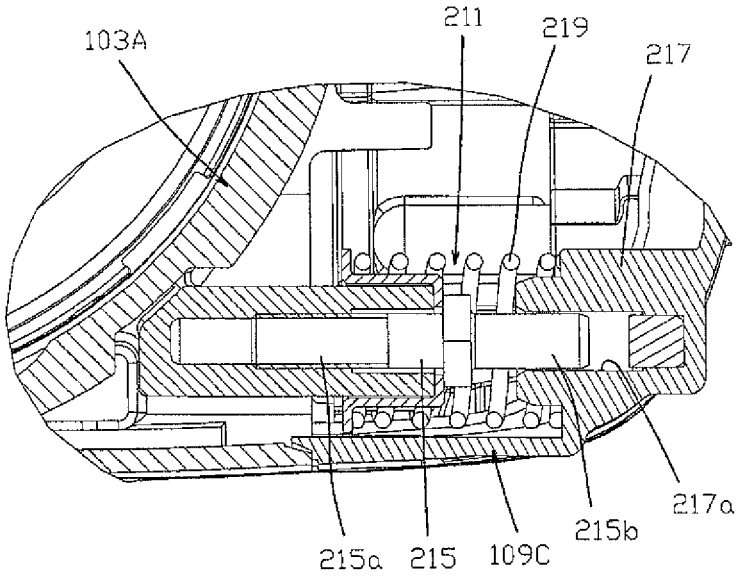
FIG. 11 shows a cross sectional view of a connecting construction between the hand grip and the main housing.
Figure 12:
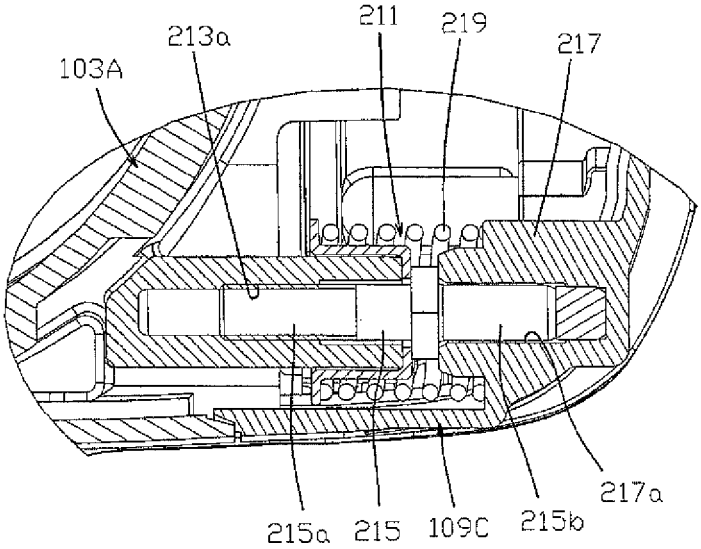
FIG. 12 shows a cross sectional view in which the hand grip is moved against the main housing.

As shown in FIG. 11 and FIG. 12, the slide guide 211 is mainly provided with a guide shaft 215 and a slide cylinder 217. The motor housing 103A of the main housing 103 includes a guide shaft 215 having a circular section for guiding the hand grip 109 in the longitudinal direction of the hammer bit 119. Further, the compression coil spring 219 is arranged outside the guide shaft 215 and coaxially with the guide shaft 215.

Each of the upper connection part 109B and the lower connection part 109C of the hand grip 109 includes the slide cylinder 217 corresponding to the guide shaft 215. The guide shaft 215 is disposed such that an outer surface of a protruding part 215*b* is slidable against an inner surface of a cylindrical hole 217*a* of the slide cylinder 217 and thereby the guide shaft 215 is slidably fitted into the slide cylinder 217. In FIG. 11 and FIG. 12, the slide guide 211 in the lower connection part 109C is illustrated. However the slide guide 211 in the upper connection part 109B is constructed similar to one of the lower connection part 109C.

As shown in FIG. 7 and FIG. 10, a side grip attachable portion 201 to which a side grip as an auxiliary handle is detachably attached is formed on the barrel cover 105C. The side grip attachable portion 201 is formed as a cylindrically shaped portion having a circular section. The side grip attachable portion 201 is one example which corresponds to "an auxiliary handle attachable portion" of this disclosure.

Further, as shown in FIG. 8, a switch operation member 177 is disposed on the hand grip 109. The switch operation member 177 is manually and slidably operated by a user in a lateral direction crossing the longitudinal direction of the hammer bit 119. By sliding the switch operation member 177, an electrical switch 173 is switched between ON and OFF states. When the electrical switch 173 is switched to the ON state, a controller 171 drives the electric motor 110 and thereby the hammering operation is performed. In the second embodiment, the controller 171 controls the electric motor 110 under substantially constant rotation speed state similar to the first embodiment.

In the electrical hammer 200 described above, during the hammering operation, the outer housing 105 and the hand grip 109 are slid against the main housing 103 in a state that biasing force of the compression coil spring 219 is applied to the outer housing 105 and the hand grip 109. Specifically, as shown in FIG. 11 and FIG. 12, the lower connection part 109C (hand grip 109) is slid against the guide shaft 215. Further, similar to the lower connection part 109C, the upper connection part 109B is sled against the guide shaft 215. Accordingly, vibration generated on the main housing 103 during the hammering operation is prevented from being transmitted to the hand grip 109. At the same time, the side grip 900 which is attached to the side grip attachable portion 201 is moved together with the hand grip 109. Accordingly, vibration transmission to the side grip 900 is also prevented. Further, as the side grip 900 and the hand grip 109 are moved integrally with each other, distance between the side grip 900 and the hand grip 109 is always kept constant. Thus, usability for a user holding the side grip 900 and hand grip 109 is improved.

During the hammering operation, the hammer bit 119 is driven via the first motion converting mechanism 120. At the same time, the dynamic vibration reducer 160 is driven by the second motion converting mechanism 220. Accordingly, the dynamic vibration reducer 160 reduces effectively vibration generated on the main housing 103 during the hammering operation. Furthermore, as the hand grip 109 is relatively moved against the main housing 103 via the compression coil spring 219, vibration transmission to the hand grip 109 is more effectively prevented.

Third Embodiment

Next, a third embodiment of the present disclosure is explained with reference to FIG. 13 to FIG. 16. In the third embodiment, an electrical hammer drill 300 is configured to perform a hammer-drill operation. Similar constructions that are the same as those in the first and second embodiments have been assigned the same reference numbers.

Figure 13:
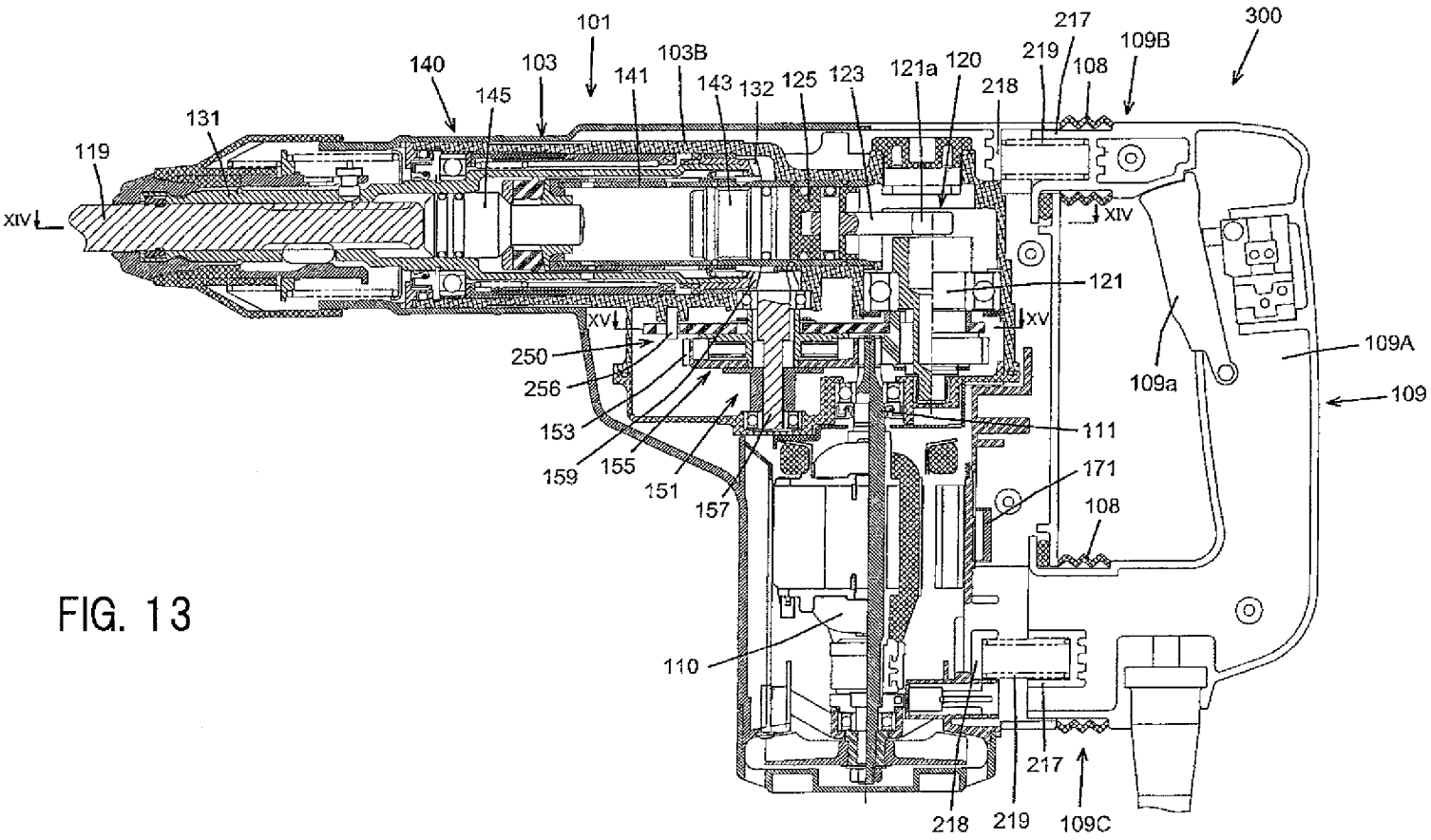
FIG. 13 shows a cross sectional view of an electrical hammer drill according to a third embodiment of the present disclosure.

As shown in FIG. 13, a main body 101 of the electrical hammer drill 300 is mainly provided with a main housing 103 and a hand grip 109 which is connected to the main housing 103. A gear housing 103B which houses an electric motor 110, a first motion converting mechanism 120, a second motion converting mechanism 250, a hammering mechanism 140 and a rotation transmitting mechanism 151 is disposed inside the main housing 103. The hand grip 109 is arranged opposite to the hammer bit 119 with respect to the main housing 103 in the longitudinal direction of the hammer bit 119. For convenience of explanation, the hammer bit 119 side in the longitudinal direction of the hammer bit 119 (longitudinal direction of the main body 101) is called front side of the electrical hammer drill 300, and the hand grip 109 side is called rear side of the electrical hammer drill 300. The main housing 103 and the hand grip 109 are examples which correspond to "a main housing" and "a handle" of this disclosure, respectively.

As shown in FIG. 13, the electric motor 110 is disposed such that a motor shaft 111 crosses the longitudinal direction of the hammer bit 119. The electric motor 110 is arranged at a lower region of the electrical hammer drill 300 and a cylinder 141 which is coaxial with the hammer bit 119 and a tool holder 131 are arranged at a upper region of the electrical hammer drill 300.

Figure 14:
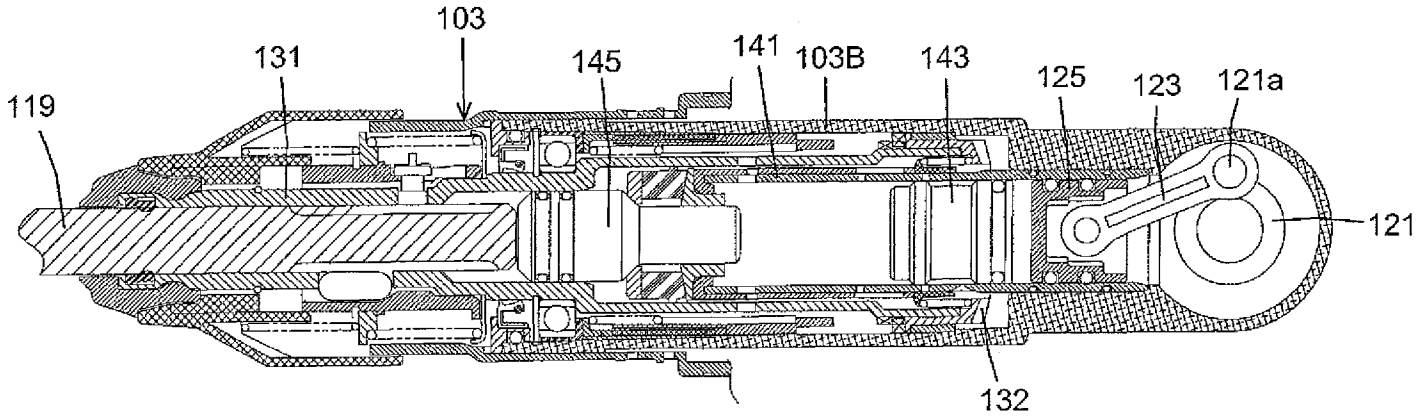
FIG. 14 shows a cross sectional view taken along the XIV-XIV line in FIG. 13.

As shown in FIG. 13 and FIG. 14, rotation of the electric motor 110 is converted to a linear motion by the first motion converting mechanism 120 disposed above the electric motor 110 and transmitted to the hammering mechanism 140 and thereby the hammer bit 119 is hit by the hammering mechanism 140 in the longitudinal direction of the hammer bit 119. Thus, a hammering force by the hammer bit 119 against a workpiece is generated. Furthermore, the rotation of the electric motor 110 is transmitted to the tool holder 131 via the rotation transmitting mechanism 151 and thereby the hammer bit 119 is rotated around its axis via the tool holder 131. Further, the rotation of the electric motor 110 is converted to a linear motion by the second motion converting mechanism 250 and transmitted to a dynamic vibration reducer 160 shown in FIG. 15. The first motion converting mechanism 120 and the hammering mechanism 140 have similar constructions as those in the first embodiment, and explanations thereof are therefore omitted. The first motion converting mechanism 120 is one example which corresponds to "a first crank mechanism" of this disclosure.

As shown in FIG. 13, the rotation transmitting mechanism 151 is mainly provided with a driven gear 153, a mechanical torque limiter 155, an intermediate shaft 157 and a small bevel gear 159. The driven gear 153 is engaged with a pinion gear disposed on the motor shaft 111 and thereby rotated by the motor shaft 111. The driven gear 153 and the intermediate gear 157 are connected via the mechanical torque limiter 155. The mechanical torque limiter 155 is configured to interrupt torque transmission between the driven gear 153 and the intermediate gear 157, when torque applied on the mechanical torque limiter 155 exceeds a predetermined threshold. The small bevel gear 159 which is engaged with a large bevel gear 132 mounted on a rear end region of the tool holder 131 is arranged at the tip end (upper end) of the intermediate shaft 157. Thus, the rotation transmitting mechanism 151 transmits rotation of the electric motor 110 to the tool holder 131.

Figure 15:
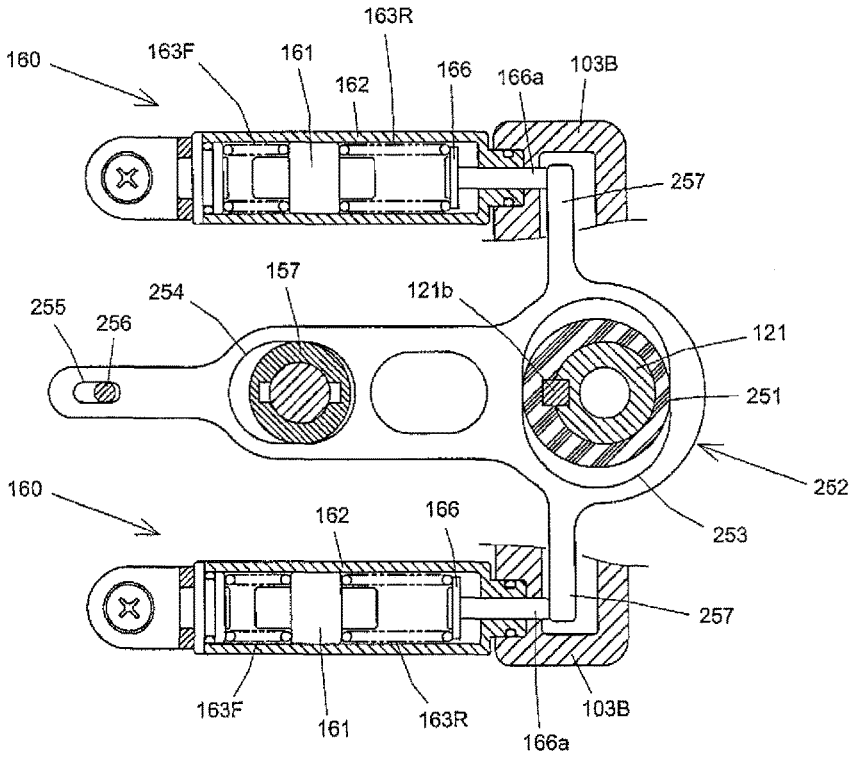
FIG. 15 shows a cross sectional view of a second motion converting mechanism and a dynamic vibration reducer.

As shown in FIG. 13, the second motion converting mechanism 250 is arranged between the tool holder 131 and the electric motor 110 in a vertical direction extending along the motor shaft 111 of the electric motor 110. As shown in FIG. 15, the second motion converting mechanism 250 is mainly provided with an eccentric shaft 251, a movable plate 252 and a guide pin 256. The eccentric shaft 251 is fitted onto the first crank shaft 121. The eccentric shaft 251 has a circular section, and the eccentric shaft 251 is arranged such that the center of the circular section is offset from the rotational center of the first crank shaft 121. The first crank shaft 121 and the eccentric shaft 251 are connected by a connection member 121*b* and thereby the first crank shaft 121 and the eccentric shaft 251 are rotated integrally.

As shown in FIG. 15, the movable plate 252 is substantially T-shaped plate in the planar view. The movable plate 252 includes an engagement hole 253 engageable with the eccentric shaft 251, a first guide hole 254 engageable with the intermediate shaft 157 of the rotation transmitting mechanism 151, a second guide hole 255 engageable with the guide pin 256, and push arms 257 engageable with the dynamic vibration reducer 160. Thus, the movable plate 252 is supported by the eccentric shaft 251 (first crank shaft 121), the intermediate shaft 157 (rotation transmitting mechanism 151) and the guide pin 256.

The engagement hole 253 has a length in the longitudinal direction of the hammer bit 119, which is the same length as the diameter of the eccentric shaft 251. Further the engagement hole 253 has a length in a lateral direction perpendicular to the longitudinal direction of the hammer bit 119, which is longer than the diameter of the eccentric shaft 251. Thus, the engagement hole 253 is provided as an elongated hole along the lateral direction. On the other hand, the first guide hole 254 and the second guide hole 255 are provided as an elongated hole along the longitudinal direction of the hammer bit 119. Further, phase differences between the eccentric shaft 251 of the second motion converting mechanism 250 and the eccentric shaft 121*a* pf the first motion converting mechanism 120 is set similar to the one in the first embodiment.

When the eccentric shaft 251 is rotated in the engagement hole 253, the eccentric shaft 251 is moved in the lateral direction within the engagement hole 253 and the eccentric shaft 251 pushes the movable plate 252 in the longitudinal direction of the hammer bit 119. Thus, the movable plate 252 is reciprocated in the longitudinal direction of the hammer bit 119 (front-rear direction). At this time, the intermediate shaft 157 engages with the first guide hole 254 and the guide pin 256 engages with the second guide hole 255. Therefore, the movable plate 252 is stably guided in the longitudinal direction of the hammer bit 119. Further, as shown in FIG. 13, the guide pin 256 is fixed on the gear housing 103B.

As shown in FIG. 15, the dynamic vibration reducers 160 are arranged at right and left side of the movable plate 252, respectively. The dynamic vibration reducer 160 is mainly provided with a weight 161, a dynamic vibration reducer body 162, biasing springs 163F, 163R, and a driving member 166. The weight 161, the biasing springs 163F, 163R and the driving member 166 are housed by the dynamic vibration reducer body 162 which is fixed to the gear housing 103B. The biasing spring 163F is arranged in front of the weight 161 between the weight 161 and the dynamic vibration reducer body 162. Further, the biasing spring 163R is arranged in the rear of the weight 161 between the weight 161 and the driving member 166. The driving member 166 includes a contact part 166*a* which protrudes rearward from the dynamic vibration reducer body 162. The rear end of the contact part 166*a* is contactable with the push arm 257 of the movable plate 252. The driving member 166 is one example which corresponds to "an intervening member" of this disclosure.

As shown in FIG. 13, the hand grip 109 includes a grip portion 109A which extends in the vertical direction of the electrical hammer drill 300, which is perpendicular to the longitudinal direction of the hammer bit 119. An upper connection part 109B and a lower connection part 109C of the hand grip 109 are connected to the main housing 103 via a compression coil spring 219. The compression coil spring 219 is supported by a spring receiver 218 formed on the main housing 103 and a slide cylinder 217 formed on the hand grip 109. Accordingly, the hand grip 109 is movable in the longitudinal direction of the hammer bit 119 with respect to the main housing 103 in a state that biasing force of the compression coil spring 219 is applied to the hand grip 109.

A trigger 109*a* is disposed on the hand grip 109. When a user pulls (manipulates) the trigger 109*a*, the electric motor 110 is driven by the controller 171. Thus, the hammer bit 119 performs the hammer-drill operation on a workpiece. In the third embodiment, the controller 171 controls the electric motor 110 under substantially constant rotation speed state similar to the first embodiment.

The hand grip 109 moves against the main body 103 in a state that the biasing force of the compression coil spring 219 is applied to the hand grip 109 during the hammer-drill operation. Accordingly, vibration transmission to the hand grip 109 from the main body 103 is prevented.

Figure 16:
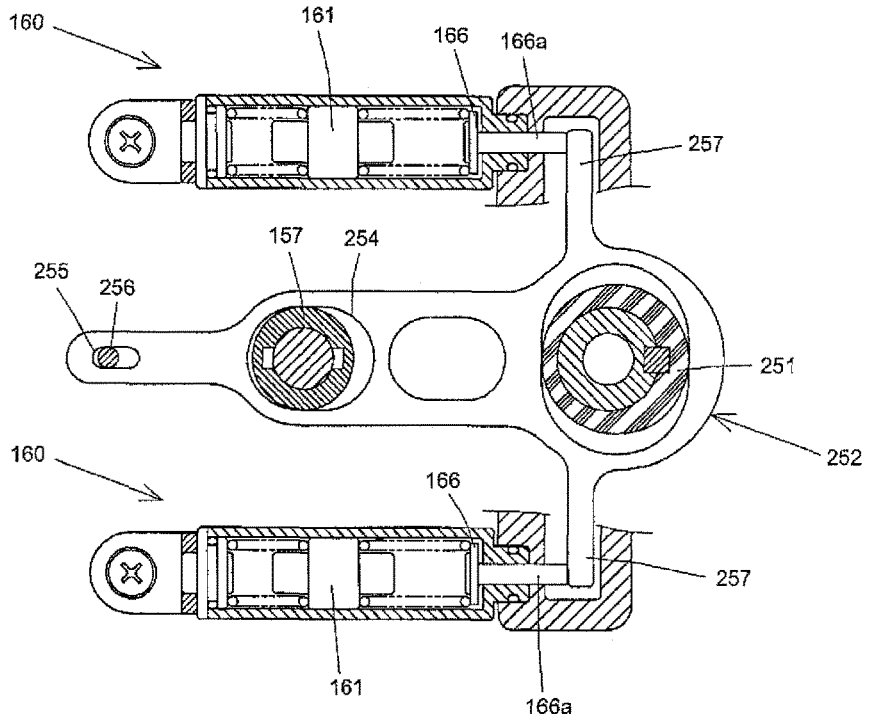
FIG. 16 shows a cross sectional view in which a weight of the dynamic vibration reducer is moved rearward.

Further, the movable plate 252 of the second motion converting mechanism 250 is moved in the front-rear direction by rotation of the electric motor 110 during the hammer-drill operation. Thereby the push arm 257 drives the driving member 166 by contacting with the contact part 166*a*. Accordingly, as shown in FIG. 15 and FIG. 16, the driving member 166 reciprocates the weight 161 via the biasing springs 163F, 163R. In other words, the weight 161 is forcibly driven by the driving member 166. Thus, vibration generated on the main housing 103 during the hammer-drill operation is reduced. The second motion converting mechanism 250 is one example which corresponds to "a second crank mechanism" of this disclosure. Further, the weight 161 and the biasing spring 163R are examples which correspond to "a weight" and "an elastic member" of this disclosure, respectively.

In the electrical hammer drill 300, two dynamic vibration reducers 160 are arranged on left side and right side with respect to the cylinder 141, respectively. Thus, with respect to a lateral direction of the electrical hammer drill 300, the gravity center of the two weights 161 approximately coincides with the center of the cylinder 141. Accordingly, vibration generated on the main housing 103 during the hammer-drill operation is effectively reduced by the two dynamic vibration reducers 160. Further, the dynamic vibration reducer 160 is arranged between the cylinder 141 and the electric motor 110 in the vertical direction of the electrical hammer drill 300. Therefore, with respect to the vertical direction, the dynamic vibration reduce 160 is disposed close to the gravity center of the electrical hammer drill 300 and vibration generated on the main housing 103 during the hammer-drill operation is further effectively reduced by the two dynamic vibration reducers 160.

Fourth Embodiment

Next, a fourth embodiment of the present disclosure is explained with reference to FIG. 17 to FIG. 20. An electrical hammer drill 400 of the fourth embodiment is configured to perform a hammering operation, a drilling operation and a hammer-drill operation. Similar constructions that are the same as those in the first to third embodiments have been assigned the same reference numbers.

Figure 17:
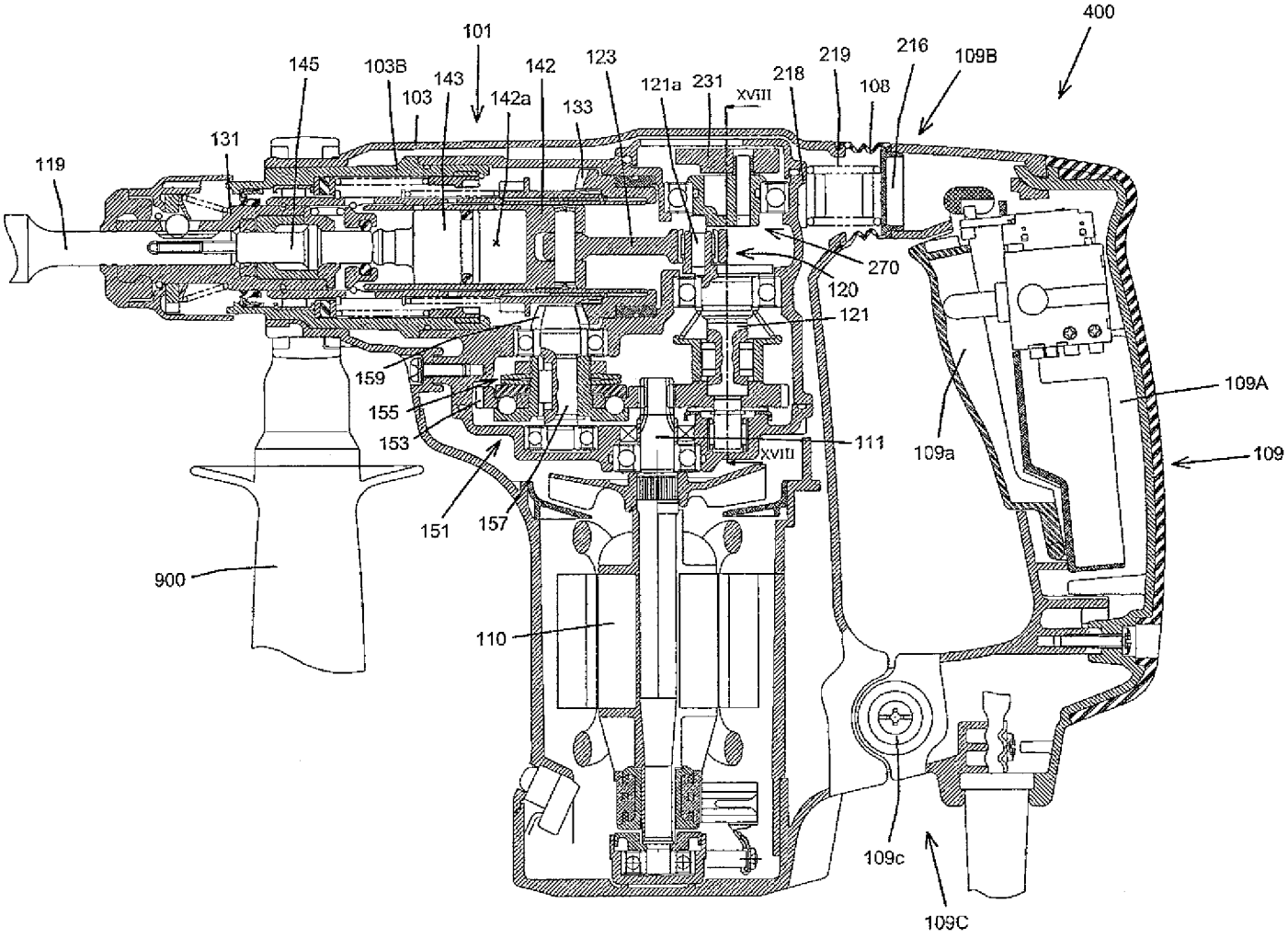
FIG. 17 shows a cross sectional view of an electrical hammer drill according to a fourth embodiment of the present disclosure.

As shown in FIG. 17, a main body 101 of the electrical hammer drill 400 is mainly provided with a main housing 103 and a hand grip 109 which is connected to the main housing 103. A gear housing 103B which houses an electric motor 110, a first motion converting mechanism 120, a second motion converting mechanism 270, a hammering mechanism 140 and a rotation transmitting mechanism 151 is disposed inside the main housing 103. The hand grip 109 is arranged opposite to the hammer bit 119 with respect to the main housing 103 in the longitudinal direction of the hammer bit 119. For convenience of explanation, the hammer bit 119 side in the longitudinal direction of the hammer bit 119 (longitudinal direction of the main body 101) is called front side of the electrical hammer drill 400, and the hand grip 109 side is called rear side of the electrical hammer drill 400.

As shown in FIG. 17, the electric motor 110 is disposed such that a motor shaft 111 crosses the longitudinal direction of the hammer bit 119. The electric motor 110 is arranged at a lower region of the electrical hammer drill 400 and a piston cylinder 142 which is coaxial with the hammer bit 119 and a tool holder 131 are arranged at a upper region of the electrical hammer drill 400.

As shown in FIG. 17, rotation of the electric motor 110 is converted to a linear motion by the first motion converting mechanism 120 disposed above the electric motor 110 and transmitted to the hammering mechanism 140 and thereby the hammer bit 119 is hit by the hammering mechanism 140 in the longitudinal direction of the hammer bit 119. Thus, a hammering force by the hammer bit 119 against a workpiece is generated. Furthermore, the rotation of the electric motor 110 is transmitted to the tool holder 131 via the rotation transmitting mechanism 151 and thereby the hammer bit 119 is rotated around its axis via the tool holder 131. Further, the rotation of the electric motor 110 is transmitted to the second motion converting mechanism 270 via the first motion converting mechanism and converted to a linear motion by the second motion converting mechanism 270 and transmitted to a counterweight 231.

As shown in FIG. 17, the first motion converting mechanism 120 is provided by a first crank mechanism which is mainly provided with a first crank shaft 121, a first connection rod 123 and so on. The first crank shaft 121 is rotationally driven by a pinion gear disposed on the motor shaft 111 of the electric motor 110. The first crank shaft 121 has an eccentric shaft 121*a* which is arranged offset from the rotational axis of the crank shaft 121. The first connection rod 123 connects the eccentric shaft 123*a* and the piston cylinder 142. The piston cylinder 142 is slidably disposed within the tool holder 131. The first motion converting mechanism 120 is one example which corresponds to "a first crank mechanism" of this disclosure.

Figure 18:
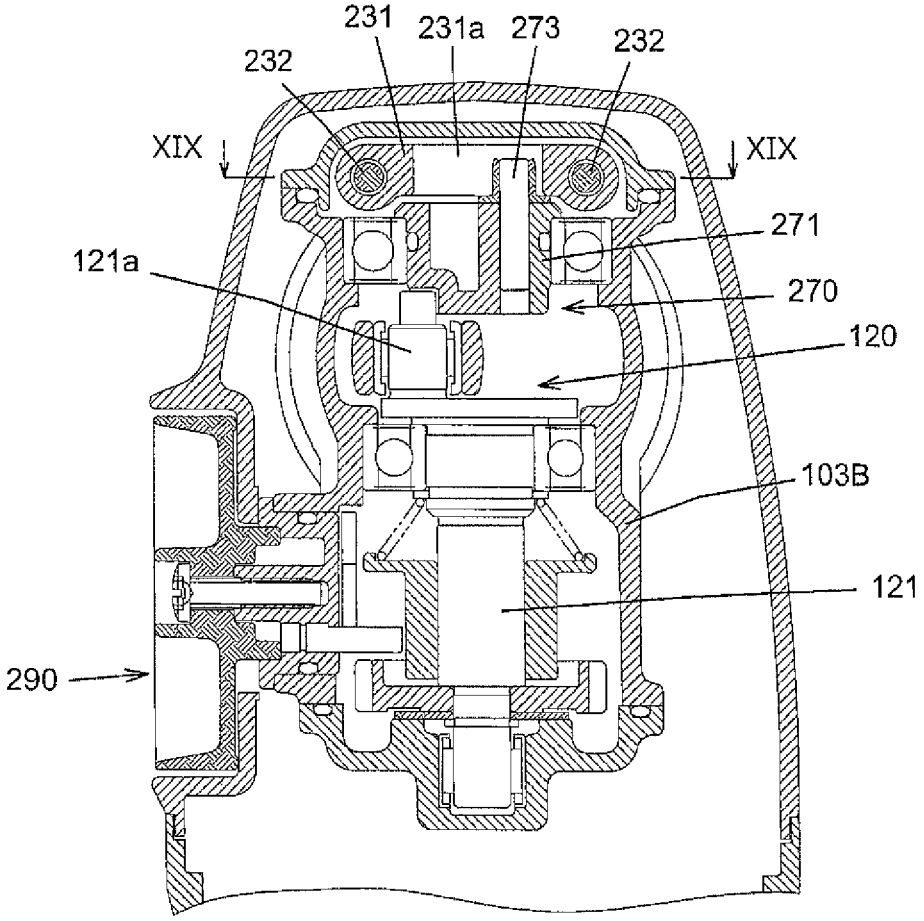
FIG. 18 show a cross sectional view taken along the XVIII-XVIII line in FIG. 17.

As shown in FIG. 17 and FIG. 18, the electrical hammer drill 400 comprises a mode switching dial 290 which switches a rotation transmitting state and a rotation transmission interrupting state. In the rotation transmitting state, rotation of the electric motor 110 is transmitted to the first crank shaft 121. On the other hand, in the rotation transmission interrupting state, transmission of rotation of the electric motor 110 to the first crank shaft 121 is interrupted. That is, the mode switching dial 290 is configured to switch the driving mode among a hammering mode, a drilling mode and a hammer-drill mode. In the hammering mode, rotation of the electric motor 110 is transmitted to the first motion converting mechanism 120 and the second motion converting mechanism 270, while rotation of the electric motor 110 is not transmitted to the rotation transmitting mechanism 151. In the drilling mode, rotation of the electric motor 110 is transmitted to the rotation transmitting mechanism, while rotation of the electric motor 110 is not transmitted to the first motion converting mechanism 120 and the second motion converting mechanism 270. Further, in the hammer-drill mode, rotation of the electric motor 110 is transmitted to the first motion converting mechanism 120, the second motion converting mechanism 270 and the rotation transmitting mechanism 151.

The hammering mechanism 140 is mainly provided with the cylinder 142, a striker 143 as a hammering element and an impact bolt 145 as an intermediate element. The striker 143 is slidably disposed in the piston cylinder 142. By the driving of the first motion converting mechanism 120, the piston cylinder 142 is slid in the tool holder 131 and thereby the striker 143 is driven by an air spring (air fluctuation) of an air chamber 142*a* formed in the piston cylinder 142. Therefore, the striker 143 hits the impact bolt 145 and thereby the impact bolt 145 hits the hammer bit 119. The hammering mechanism 140 is one example which corresponds to "a driving mechanism" of this disclosure. Further, the piston cylinder 142 and the striker 143 are examples which correspond to "a cylinder" and "a hammering mechanism" of this disclosure, respectively.

As shown in FIG. 17, the rotation transmitting mechanism 151 is mainly provided with a driven gear 153, a mechanical torque limiter 155, an intermediate shaft 157 and a small bevel gear 159. The driven gear 153 is engaged with the pinion gear disposed on the motor shaft 111 and thereby rotated by the motor shaft 111. The driven gear 153 and the intermediate gear 157 are connected via the mechanical torque limiter 155. The mechanical torque limiter 155 is configured to interrupt torque transmission between the driven gear 153 and the intermediate gear 157, when torque applied on the mechanical torque limiter 155 exceeds a predetermined threshold. The small bevel gear 159 which is engaged with a large bevel gear 133 is arranged at the tip end (upper end) of the intermediate shaft 157. The large bevel gear 133 is disposed on a rear end region of the tool holder 131 via a spline coupling to engage and disengage with the tool holder 131. Thus, the rotation transmitting mechanism 151 transmits rotation of the electric motor 110 to the tool holder 131 by engagement between the large bevel gear 133 and the tool holder 131. Further, the rotation transmission is interrupted by disengaging the bevel gear 133 from the tool holder 131. The engagement and disengagement of the spline coupling between the bevel gear 133 and the tool holder 131 are switched by operating the mode switching dial 290.

As shown in FIG. 17 and FIG. 18 the second motion converting mechanism 270 is provided by a second crank mechanism which comprises a second crank shaft 271 and an eccentric shaft 273. The second crank shaft 271 is rotatably connected to the eccentric shaft 121*a* of the first crank shaft 121 and driven by the eccentric shaft 121*a*. The eccentric shaft 273 is arranged offset from the rotational axis of the second crank shaft 271. The second motion converting mechanism 270 is one example which corresponds to "a second crank mechanism" of this disclosure.

Figure 19:
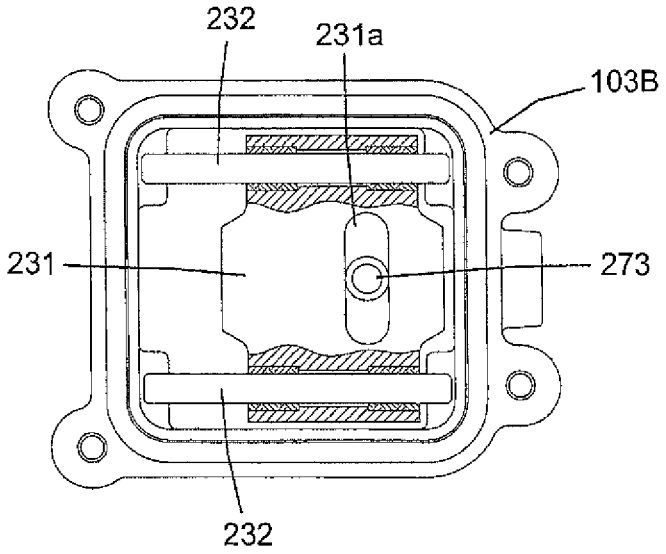
FIG. 19 shows a cross sectional view of a counterweight driven by a second motion converting mechanism.

As shown in FIG. 18 and FIG. 19, a counterweight 231 is arranged above the second motion converting mechanism 270. That is, the counterweight 231 is arranged above the tool holder 131 or the piston cylinder 142 which are coaxial with the hammer bit 119 in a vertical direction in which the grip portion 109A of the hand grip 109 extends. The counterweight 231 is engaged with the eccentric shaft 273 and thereby linearly driven in the longitudinal direction of the hammer bit 119 by the second motion converting mechanism 270.

Specifically, the counterweight 231 has an engagement hole 231*a* which engages with the eccentric shaft 273. The engagement hole 231*a* is formed as an elongate hole extends in a lateral direction crossing the longitudinal direction of the hammer bit 119. Further, two guide shafts 232 are disposed so as to penetrate the counterweight 231 in the longitudinal direction of the hammer bit 119. The guide shaft 232 is disposed parallel to the longitudinal direction of the hammer bit 119 and fixed on the gear housing 103B. Thereby the counterweight 231 is guided by the guide shaft 232 in the longitudinal direction of the hammer bit 119.

By a circular movement of the eccentric shaft 273 of the second motion converting mechanism 270, the eccentric shaft 273 moves within the engagement hole 231*a* of the counterweight 231 in the lateral direction and, at the same time, the eccentric shaft 273 moves in the longitudinal direction of the hammer bit 119. Thereby the counterweight 231 is moved in the longitudinal direction of the hammer bit 119. Further, phase differences between the eccentric shaft 253 of the second motion converting mechanism 270 and the eccentric shaft 121*a* pf the first motion converting mechanism 120 is set similar to the one in the first embodiment. The counterweight 231 is one example which corresponds to "a weight" of this disclosure.

As shown in FIG. 17, the hand grip 109 has the grip portion 109A which extends in the vertical direction of the electrical hammer drill 400. The hand grip 109 is connected to the main housing 103 via a compression coil spring 219 at an upper connection part 109B. The compression coil spring 219 is supported by a spring receiver 218 disposed on the main housing 103 and a spring receiver 216 disposed on the handgrip 109. Further, the hand grip 109 is rotatably connected to the main housing 103 at a lower connection part 109C via a rotation support part 109*c* as a pivot. Accordingly, the hand grip 109 is rotated around the rotation support part 109*c* of the lower connection part 109C and the upper connection part 109B is moved with respect to the main housing 103 in a state that biasing force of the compression coil spring 219 is applied.

Further, a trigger 109*a* is disposed on the hand grip 109. When the trigger 109*a* is pulled, the electric motor 110 is turned on and driven. Accordingly, the electrical hammer drill 400 performs the operation based on the driving mode selected by the mode switching dial 290.

The hand grip 109 is moved with respect to the main housing 103 during the operation in a state that biasing force of the compression coil spring 219 is applied. Accordingly, vibration transmission to the hand grip 109 from the main housing 103 is prevented.

Figure 20:
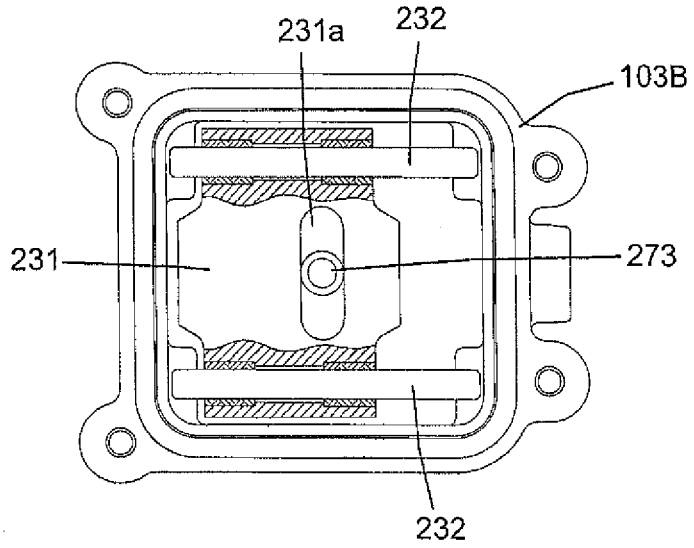
FIG. 20 shows a cross sectional view in which the counterweight is moved forward.

Further, during the hammering operation or the hammer-drill operation, the second motion converting mechanism 270 is driven by rotation of the electric motor 110 and thereby the counterweight is linearly reciprocated in the longitudinal direction of the hammer bit 119 between a position shown in FIG. 19 and a position shown in FIG. 20. Accordingly, vibration generated on the main housing 103 during the hammering operation or the hammer-drill operation is reduced.

The counterweight 231 is arranged above the piston cylinder 142 in the vertical direction of the electrical hammer drill 400. On the other hand, the electric motor 110 having relatively large weight is arranged below the piston cylinder 142. Accordingly, the electrical hammer drill is balanced by the counterweight 231 and the electric motor 110.

According to the embodiments described above, the hand grip 109, 500 is moved with respect to the main housing 103 during the operation in a state that biasing force of the biasing member is applied. Therefore, vibration transmission from the main housing 103 to the hand grip 109, 500 during the operation is prevented. Further, as the electric motor 110 drives the counterweight 231 or the weight 161 of the dynamic vibration reducer 160 forcibly, vibration generated on the main housing 103 during the operation is reduced. That is, the impact tool of this disclosure has a vibration proof mechanism which prevents vibration transmission to the hand grip and a vibration reduction mechanism which reduces vibration generated on the main housing. Accordingly, vibration of the hand grip which is held (griped) by a user is reduced and thereby usability of the impact tool is improved.

Further, according to the second and third embodiments, in the electrical hammer 200 and the electrical hammer drill 300 which have the dynamic vibration reducer 160, the controller 171 controls the electric motor 110 under substantially constant rotation speed state. In the dynamic vibration reducer 160, the weight 161 and biasing members 163F, 163R are set to work effectively under a predetermined frequency based on mass of the weight 161 and the spring constant of the biasing members 163F, 163R such that the dynamic vibration reducer 160 can reduce vibration generated on the main housing 103. Accordingly, as the controller 171 controls rotation speed of the electric motor 110, the weight 161 is driven by the predetermined frequency. Therefore, the dynamic vibration reducer 160 effectively reduces vibration generated on the main housing 103. In this regard, in the first and fourth embodiments, the electric motor 110 may not be controlled under the substantially constant rotation speed state.

In the embodiments described above, the main housing houses the electric motor 110, and the hammering mechanism 140, the first motion converting mechanism 120 and the second motion converting mechanism 220, 250, 270 as a driving mechanism, however it is not limited to such a construction. For example, the electric motor 110 may not be housed by the main housing 103 but the hand grip 109, 500.

Further, in the third embodiment, the weight 161 is arranged below the cylinder 141 and, in the fourth embodiment, the counterweight 231 is above the piston cylinder 142, however it is not limited to such a construction. For example, the weight 161 may be arranged above the cylinder 141 and the counterweight 231 may be arranged below the piston cylinder 142.

Further, in the fourth embodiment, the electrical hammer drill 400 comprises the mode switching dial 290 which switches the driving mode of the electrical hammer drill 400. However, it is not limited to such a construction. That is, the impact tool of this disclosure may be configured to perform at least the hammering operation, and the drilling operation or the hammer-drill operation may not be performed.

The correspondence relationships between components of the embodiments and claimed inventions are as follows. The embodiments describe merely examples of configurations for carrying out the claimed inventions. However the claimed inventions are not limited to the configurations of the embodiments.

The electrical hammer 100, 200 is one example of a configuration that corresponds to "an impact tool" of the invention.

The electrical hammer drill 300, 400 is one example of a configuration that corresponds to "an impact tool" of the invention.

The main housing 103 is one example of a configuration that corresponds to "a main housing" of the invention.

The outer housing 105 is one example of a configuration that corresponds to "an outer housing" of the invention.

The hand grip 109, 500 is one example of a configuration that corresponds to "a handle" of the invention.

The electric motor 110 is one example of a configuration that corresponds to "a motor" of the invention.

The motor shaft 110 is one example of a configuration that corresponds to "a motor shaft" of the invention.

The compression coil spring 219, 321 is one example of a configuration that corresponds to "a biasing member" of the invention.

The counterweight 231 is one example of a configuration that corresponds to "a weight" of the invention.

The weight 161 is one example of a configuration that corresponds to "a weight" of the invention.

The first motion converting mechanism 120 is one example of a configuration that corresponds to "a first crank mechanism" of the invention.

The second motion converting mechanism 220, 250, 270 is one example of a configuration that corresponds to "a second crank mechanism" of the invention.

The hammering mechanism 140 is one example of a configuration that corresponds to "a driving mechanism" of the invention.

The rotation transmitting mechanism 151 is one example of a configuration that corresponds to "a driving mechanism" of the invention.

The cylinder 141 is one example of a configuration that corresponds to "a cylinder" of the invention.

The piston cylinder 142 is one example of a configuration that corresponds to "a cylinder" of the invention.

The striker 143 is one example of a configuration that corresponds to "a hammering element" of the invention.

The second connection rod 225 is one example of a configuration that corresponds to "an intervening member" of the invention.

The slide sleeve 165 is one example of a configuration that corresponds to "an intervening member" of the invention.

The biasing spring 163R is one example of a configuration that corresponds to "an intervening member" of the invention.

The biasing spring 163R is one example of a configuration that corresponds to "an elastic member" of the invention.

DESCRIPTION OF NUMERALS

100 electrical hammer
101 main body
103 main housing
103A motor housing
103B gear housing
103C rear cover
104 barrel portion
105 outer housing
105A upper housing cover
105B lower housing cover
105C barrel cover
106 upper housing
107 lower housing
108 bellows member
109 hand grip
109A grip portion
109B upper connection part
109C lower connection part
110 electric motor
111 motor shaft
113 gear mechanism
119 hammer bit
120 first motion converting mechanism
121 first crank shaft
121*a* eccentric shaft
123 first connection rod
125 piston
131 tool holder
132 large bevel gear
133 large bevel gear
140 hammering mechanism
141 cylinder
141*a* air chamber
142 piston cylinder
142*a* air chamber
143 striker
145 impact bolt
151 rotation transmitting mechanism
153 driven gear
155 mechanical torque limiter
157 intermediate shaft
159 small bevel gear
160 dynamic vibration reducer
161 weight
162 dynamic vibration reducer body
163F biasing spring
163R biasing spring
165 slide sleeve

166 driving member
167 ring-like member
171 controller
173 electrical switch
177 switch operation member
200 electrical hammer
201 side grip attachable portion
211 slide guide
215 guide shaft
216 spring receiver
217 slide cylinder
218 spring receiver
219 compression coil spring
220 second motion converting mechanism
221 second crank shaft
223 eccentric shaft
225 second connection rod
227 inner crank shaft
229 outer crank shaft
231 counterweight
231*a* engagement hole
232 guide shaft
233 connection shaft
235 bearing holder
237 needle bearing
241 cylinder receiver
250 second motion converting mechanism
251 eccentric shaft
252 movable plate
253 engagement hole
254 first guide hole
255 second guide hole
256 guide pin
257 push arm
270 second motion converting mechanism
271 second crank shaft
273 eccentric shaft
290 mode switching dial
300 electrical hammer drill
319 guide shaft
321 compression coil spring
323 slide cylinder
400 electrical hammer drill
500 hand grip
510 electrical switch
520 trigger
525 supporting part
541 controller
900 side grip

The invention claimed is:

1. An impact tool which drives a tool bit in a longitudinal direction of the tool bit and performs a predetermined operation, comprising:

a motor which includes a motor shaft, a driving mechanism which is driven by the motor and drives the tool bit, a main housing which houses the driving mechanism, a handle which includes a grip portion extending in a cross direction crossing the longitudinal direction of the tool bit, the handle being configured to be moved with respect to the main housing, a biasing member which is arranged between the main housing and the handle and applies biasing force on the handle, a weight which is housed in the main housing and movable with respect to the main housing, a first crank mechanism which has a first rotation shaft and a first eccentric shaft which is offset from the rotational center of the first rotation shaft, the first crank mechanism being configured to be driven by the motor and drive the driving mechanism, and a second crank mechanism which has a second rotation shaft and a second eccentric shaft which is offset from the rotational center of the second rotation shaft, the second crank member being configured to be driven by the motor and drive the weight such that the weight is relatively moved with respect to the main housing, wherein the weight is configured to reduce vibration generated on the main housing during the operation by relatively moving with respect to the main housing, the handle is configured to prevent vibration transmission from the main housing to the handle during the operation by relatively moving with respect to the main housing in a state that the biasing force of the biasing member is applied on the handle, and the first and second eccentric shafts are disposed such that when the first eccentric shaft is positioned at the closest position to the tool bit in the longitudinal direction of the tool bit within its movable range, the second eccentric shaft is positioned at a position other than the closest position to the tool bit in the longitudinal direction of the tool bit and the most distant position from tool bit in the longitudinal direction of the tool bit within its movable range.

2. The impact tool according to claim 1, comprising an intervening member which is arranged between the weight and the second eccentric shaft, wherein the weight is driven by the second crank mechanism via the intervening member.

3. The impact tool according to claim 2, wherein the intervening member is provided as an elastically deformable elastic member, wherein the weight is driven by the second crank mechanism via the elastic member.

4. The impact tool according to claim 1, wherein a moving amount of the second eccentric shaft in the longitudinal direction of the tool bit is defined to be equal to a moving amount of the weight in the longitudinal direction of the tool bit.

5. The impact tool according to claim 1, wherein the weight is connected directly to the second eccentric shaft.

6. The impact tool according to claim 1, wherein the motor is arranged such that the motor shaft crosses the axial line of the tool bit.

7. The impact tool according to claim 1, wherein the driving mechanism comprises a hammering element for hammering the tool bit, and a cylinder which holds the hammering element slidably therein and is coaxial with the axial line of the tool bit, and the weight is arranged outside of the cylinder so as to surround at least part of the cylinder.

8. The impact tool according to claim 7, wherein the gravity center of the weight is arranged so as to overlap with the cylinder on a cross section perpendicular to the axial line of the tool bit.

9. The impact tool according to claim 1, wherein the driving mechanism comprises a hammering element for hammering the tool bit, and a cylinder which holds the hammering element slidably therein and is coaxial with the axial line of the tool bit, and the weight comprises a pair of weight components which are arranged at both outsides of the cylinder with respect to a plane including the axial line of the tool bit and a grip portion extending line, respectively.

10. The impact tool according to claim 1, wherein the driving mechanism comprises a hammering element for hammering the tool bit, and a cylinder which holds the hammering element slidably therein and is coaxial with the axial line of the tool bit, and the weight is arranged in at least one of outer regions of the cylinder in the crossing direction.

11. The impact tool according to claim 1, wherein the handle is relatively moved with respect to the main housing in the longitudinal direction of the tool bit.

12. The impact tool according to claim 11, comprising a rotation support part which rotatably supports the handle with respect to the main housing such that the handle is rotated on a plane including the axial line of the tool bit and a grip part extending line, wherein the biasing member is arranged on the plane distant from the rotation support part.

13. The impact tool according to claim 1, comprising an outer housing which covers at least a part of a region of the main housing which houses the driving mechanism and the motor, wherein the handle is connected to the outer housing and integrally moved with the outer housing with respect to the main housing.

14. The impact tool according to claim 13, comprising an auxiliary handle attachable part to which an auxiliary handle is detachably attached, wherein the auxiliary handle attachable part is connected to the outer housing and integrally moved with the handle connected to the outer housing with respect to the main housing.

15. The impact tool according to claim 1, wherein the first rotation shaft and the second rotation shaft are arranged coaxially with each other.

16. The impact tool according to claim 1, comprising a controller which controls rotation speed of the motor to be driven at substantially constant rotation speed.

17. The impact tool according to claim 1, wherein a phase of the first eccentric shaft and a phase of the second eccentric shaft is set to approximately 90 degrees.

18. An impact tool which drives a tool bit in a longitudinal direction of the tool bit and performs a predetermined operation, comprising:

a motor which includes a motor shaft, a driving mechanism which is driven by the motor and drives the tool bit, a main housing which houses the driving mechanism, a handle which includes a grip portion extending in a cross direction crossing the longitudinal direction of the tool bit, the handle being configured to be moved with respect to the main housing, a biasing member which is arranged between the main housing and the handle and applies biasing force on the handle, a weight which is housed in the main housing and movable with respect to the main housing, a first crank mechanism which has a first rotation shaft and a first eccentric shaft which is offset from the rotational center of the first rotation shaft, the first crank mechanism being configured to be driven by the motor and drive the driving mechanism, a second crank mechanism which has a second rotation shaft and a second eccentric shaft which is offset from the rotational center of the second rotation shaft, the second crank member being configured to be driven by the motor and drive the weight such that the weight is relatively moved with respect to the main housing, and an outer housing which covers at least a part of a region of the main housing which houses the driving mechanism and the motor, wherein the weight is configured to reduce vibration generated on the main housing during the operation by relatively moving with respect to the main housing, the handle is configured to prevent vibration transmission from the main housing to the handle during the operation by relatively moving with respect to the main housing in a state that the biasing force of the biasing member is applied on the handle, and the handle is connected to the outer housing and integrally moved with the outer housing with respect to the main housing.

* * * * *